US005416992A

United States Patent [19]

Ueda et al.

[11] Patent Number: 5,416,992

[45] Date of Patent: May 23, 1995

[54] APPARATUS FOR SPREADING RECTANGULAR CLOTH

[75] Inventors: Atsushi Ueda; Hidetoshi Ishihara; Kouichi Jinno; Kimiharu Fujihashi; Kazuo Kitajima; Toshio Hattori; Hiroyuki Asaoka, all of Nagoya, Japan

[73] Assignee: Mitsubishi Jukogyo Kabushiki Kaisha, Tokyo, Japan

[21] Appl. No.: 217,504

[22] Filed: Mar. 24, 1994

[30] Foreign Application Priority Data

Apr. 16, 1993 [JP] Japan ..... 5-112459
Jun. 11, 1993 [JP] Japan ..... 5-164982

[51] Int. Cl.[6] ..... D06F 67/04; B65G 47/22

[52] U.S. Cl. ..... 38/143; 198/689.1

[58] Field of Search ..... 38/8, 12, 143; 198/571, 198/572, 575, 577, 689.1, 751, 811

[56] References Cited

U.S. PATENT DOCUMENTS

| | | | |
|---|---|---|---|
| 1,912,466 | 6/1933 | Remington | 38/143 |
| 3,414,997 | 12/1968 | Henry | 38/143 |
| 3,464,131 | 9/1969 | McCabe | 38/143 |
| 3,564,738 | 2/1971 | Batzdorff et al. | 38/143 |
| 3,568,342 | 3/1971 | Betsch | 38/143 |
| 3,735,512 | 5/1977 | Ross | 38/143 |
| 3,772,808 | 11/1973 | Behn | 38/143 |
| 4,053,967 | 10/1977 | Mair | 38/143 |
| 5,179,795 | 1/1993 | Nakamura et al. | 38/143 |
| 5,285,621 | 2/1994 | Ballestrazzi et al. | 198/575 X |

FOREIGN PATENT DOCUMENTS

| | | | |
|---|---|---|---|
| 0149221 | 8/1984 | Japan . | |
| 2221226 | 1/1990 | United Kingdom | 38/143 |

*Primary Examiner*—Clifford D. Crowder
*Assistant Examiner*—Ismael Izaguirre
*Attorney, Agent, or Firm*—McGlew and Tuttle

[57] ABSTRACT

An apparatus for spreading rectangular cloth including a suction duct having many holes on the half surface on the cloth edge side on the cloth running surface of the mounting stand, comprises belt moving/stopping units which are arranged on the mounting stand and each of which comprises a unit base on a fixed member above the mounting stand, an operating lever rotating around the fixed shaft of the unit base, a brake roller which is mounted to the operating lever and simultaneously drives and stops a single or plural conveyor belts, an air actuator for operating the operating lever, and a sensor for detecting the side edge of the cloth drawn at right angles to the conveyor running direction; and a control circuit which issues a command to the air actuator based on the cloth detection signal generated by the sensor for each of the belt moving/stopping unit; and the apparatus additionally have a cloth position control function to stop a single or plural conveyors by applying brake upon receipt of the cloth passage detection signal generated by the sensor for each of the belt moving/stopping unit when the cloth is placed on the mounting stand and the conveyor belt starts running.

5 Claims, 26 Drawing Sheets

APPARATUS FOR SPREADING RECTANGULAR CLOTH

FIELD OF THE INVENTION AND RELATED ART STATEMENT

The present invention relates to an apparatus for spreading a rectangular cloth which spreads a rectangular cloth such as sheets from a hung condition.

The conventional apparatus in which a rectangular cloth is pulled to spread one side thereof while one edge is gripped is disclosed in Japanese Patent Laid-Open No. H4-9198. This apparatus will be described with reference to FIGS. 28 to 33.

The conventional spreading apparatus shown in FIGS. 28 to 32 spreads, for example, a rectangular cloth Y, such as a sheet, as shown in FIG. 33. The apparatus basically comprises a rectangular parallelopiped frame 1 which is formed by assembling frame members longitudinally, laterally, and vertically and has a considerable length in the longitudinal direction (considerably longer than the total length of the longer side of the rectangular cloth Y to be handled); a moving member 2 which moves longitudinally with respect to the frame 1 at a position over the frame 1; cloth corner holding means 22 and cloth edge holding means 23 which are located at two positions on the moving member 2 with a predetermined space therebetween horizontally and laterally and detachably hold one corner $C_1$ and part $Y_a'$ of the edge $Y_a$ adjoining the corner, respectively; a moving member driving unit 3 which moves the moving member 2 in the range from the cloth holding position P at the front of the frame 1 to the cloth drawing position Q at the rear of the frame 1; a mounting stand 4 which is installed on the frame 1 and supports the rectangular cloth Y, which is drawn to the rear of the frame 1, from the below; a conveyor 5 constituting part of the mounting stand 4; a conveyor driving unit 6 for running the conveyor 5 in the normal and reverse directions; a side edge detector 71 for detecting the edge-aligning side edge $Y_b$ of the rectangular cloth Y; an end edge detector 72 for detecting the end edge $Y_c$ of the rectangular cloth Y; and a controller 10 for controlling the operation of the spreading apparatus.

A single guide rail 11 is mounted in the longitudinal direction at the middle position of the frame width over the frame 1. The guide rail 11 guides the moving member 2 so as to allow it to move longitudinally with respect to the frame 1. The range in which the moving member 2 can move longitudinally is set beyond the range from the cloth holding position P where holding means 22 and 23 can hold the rectangular cloth Y at the front of the frame 1 as shown in FIG. 28 to the cloth drawing position Q where the moving member 2 can completely draw onto the mounting stand 4 the rectangular cloth Y at the rear of the frame 1 as shown in FIG. 32.

The moving member 2 is formed by a flat plate 20 having a length as large as a lateral shoulder to shoulder width of a human (a length of about 40 to 60 cm). At right and left sides of the flat plate 20, suspending plates bent downward are disposed. At the front ends of the suspending plate 21 and 21, holding means 22 and 23 are installed, respectively, to hold the rectangular cloth Y. Viewed from the front of the frame 1, the holding means 22 located at the right holds the cloth corner $C_1$, and the holding means 23 located at the left holds the cloth edge. Each of the holding means 22 and 23 uses a clip-type air chuck operated by compressed air.

The moving member driving unit 3 includes sprockets 32, 32 disposed at the front and rear of the frame 1, respectively, a chain 33 with ends, which is installed between sprockets 32 and 32, and a motor 31 for rotating one sprocket 32 in the normal and reverse directions. One end of the chain 33 is fixed to the moving member 2 after being wound around the front sprocket 32. The other end of the chain 33 is fixed to the moving member 2 after being wound around the rear sprocket 32. Therefore, the moving member driving unit 3 can advance or retreat the moving member 2 along the guide rail 11 by rotating the sprocket 32 clockwise or counterclockwise by means of the motor 31.

The mounting stand 4 is located at a position slightly lower than the height position where the holding means 22 and 23 move. The mounting stand 4 includes a front stand plate 41 of a relatively short length longitudinally, a rear stand plate 43 disposed continuously at the rear edge of the front stand plate 41, and a conveyor 5 which can run horizontally and laterally at a position near the rear end of the front stand plate 41. The conveyor 5 is composed of a set of four belts 52, 52 set between a pair of right and left rolls 51 and 51. Between the belts 52, 52 is provided an appropriate gap S. The upper side running portion of each belt 52, 52 is located so as to run at a position near the upper side of the rear stand plate 43. The conveyor driving unit 6 can rotate one (left) roll 51 for the conveyor 5 in the normal and reverse directions via the sprocket and chain by means of a motor 61 which can rotate in the normal and reverse directions.

The side edge detector 71 detects the edge-aligning side edge $Y_b$ of the rectangular cloth at the conveyor installation portion when the rectangular cloth Y is drawn to the far side of the frame 1. This detector uses a photoelectric tube. In this side edge detector 71, a detecting portion is located upward in the gap S between the first and second belts 52, 52 from the frame front side of the conveyor 5 on the rear stand plate 43 and substantially just under the position through which the cloth corner holding means 22 passes.

The end edge detector 72 uses a photoelectric tube to detect the presence of the end edge $Y_c$ of the rectangular cloth when the end edge $Y_c$ comes to the end of the conveyor 5 on the frame front side on the mounting stand 4. Namely, in the end edge detector 72, a detecting portion is located upward near the end of the conveyor 5 on the frame front side on the rear stand plate 43 and substantially just under the position through which the approximately middle portion in the lateral direction of the moving member 2 passes. The side edge detector 71 and the end edge detector 72 each determine whether the cloth is detected or not, and the detection signal is sent to the controller 10.

The controller 10 controls the conveyor driving unit 6 so as to run the conveyor 5 in the normal or reverse direction upon receipt of the signal from the side edge detector 71, and controls the moving member driving unit 3 so as to stop the operation thereof. Specifically, when the side edge detector 71 does not detect a cloth (when a cloth is absent just over the side edge detector 71), the controller 10 controls the conveyor driving unit 6 so that the upper side of the conveyor 5 runs in the direction in which the side edge is pushed out (left to right). When the side edge detector 71 detects a cloth, the controller 10 controls the conveyor driving unit 6 so that the upper side of the conveyor 5 runs in the direction in which the side edge is drawn (right to left).

Therefore, the position of the edge-aligning side edge $Y_b$ of the portion of the rectangular cloth Y in contact with the conveyor 5 is finely adjusted only in the narrow range at the right and left of the detecting position of the side edge detector 71. When the rectangular cloth Y is drawn to the far side of the frame 1 together with the moving member 2, the end edge detector 72, which has been in the condition where a cloth is not detected, detects a cloth when the rectangular cloth Y comes to the position over the end edge detector 72. When the moving member 2 further retreats and the end edge $Y_c$ of the rectangular cloth Y moves to the far side from the detecting position of the end edge detector 72, the end edge detector 72 again becomes in the condition where a cloth is not detected. Upon receipt of the signal generated at this time by the end edge detector 72, the controller 10 controls the moving member driving unit 3 so as to immediately stop the operation thereof.

However, when the rectangular cloth is drawn onto the mounting stand consisting of feed belts while providing frictional resistance at a convex front edge, the side edge of the rectangular cloth tends to spread like an unfolded fan, not in parallel to the tractive direction. To correct the side edge of the cloth to a position in parallel to the tractive direction, a mechanism for aligning the side edge of the cloth by means of a divided feed belt conveyor is disclosed in Japanese Patent Laid-Open No. H4-9198.

However, this conventional mechanism is complex, and machine costs are high. In addition, the time for correcting the side edge position of the cloth is added to the time for spreading the cloth, so that the spread cycle time of the cloth is lengthened, by which the capacity cannot be increased. Also, since the correction of the position of cloth side edge is performed after the cloth is drawn and placed, the cloth has no tension, and wrinkled cloth is sent to the following process. As a result, the finish quality of sheets deteriorates on an ironer apparatus in the subsequent process.

Since the rectangular cloth is drawn onto the mounting stand while one corner and one place on the side including the corner are gripped by a gripping device, the corner diagonally located with respect to the gripped corner hangs down like a tail and overhangs from the mounting stand. Therefore, when the cloth is transferred at right angles, it may be caught by the structure of the apparatus. If the tail-shaped portion of the cloth corner is to be drawn onto the mounting stand when the cloth is drawn by the gripping device, a longer mounting stand is needed, so that the entire machine becomes large.

Although the ordinary cloth has a rectangular shape, the cloth which is subjected to several cycles of washing may be deformed. When such a deformed cloth is drawn onto the mounting stand while its one corner and one place on the side including the corner are gripped by the gripping device, the deformed cloth is incompletely caught by the convex front edge, so that the side edge of the rectangular cloth becomes oblique with respect to the tractive direction when being drawn onto the mounting stand, or the cloth comes off from the convex front edge, which makes spreading impossible. In this case, this cloth is rejected in the subsequent process, resulting in the decrease in yield of the work. If the cloth is drawn obliquely, sent to the following process without being rejected, and spread, the finish quality as a wash becomes poor. Therefore, improvement is needed.

OBJECT AND SUMMARY OF THE INVENTION

The present invention was made to solve the aforementioned problems.

Accordingly, the present invention provides a cloth spreading apparatus which provides the functional steps of naturally hanging a rectangular cloth by gripping any corner and one place on the side including the corner by a movable gripping device which is provided with two clips, pulling the cloth horizontally on the upper surface of a mounting stand composed of a conveyor belt, etc. by the gripping device with the cloth contacting the convex front edge of the mounting stand, and drawing the cloth onto the mounting stand. The device comprises a suction duct having many suction holes on the half surface on the cloth edge side on the cloth running surface of the mounting stand; belt moving/stopping units which are arranged on the mounting stand and each of which includes a unit base installed on a fixed member above the mounting stand, an operating lever rotating around the fixed shaft of the unit base, a brake roller which is mounted to the operating lever and simultaneously drives and stops a single or plural conveyor belts, an air actuator for operating the operating lever; a sensor for detecting the side edge of the cloth drawn at right angles to the conveyor belt running direction; and a control circuit which issues commands to the air actuator based on the cloth detection signal generated by the sensor for each belt moving/stopping unit, wherein a cloth position control function is added to stop a single or plural conveyors by applying a brake upon receipt of the cloth passage detection signal generated by the sensor for each belt moving/stopping unit when the cloth is placed on the mounting stand and the conveyor belt starts running.

Further, the present invention provides a rectangular cloth spreading apparatus which is provided with a cloth side edge aligning mechanism comprising a suction belt which is disposed at the lower part of the convex front edge, which is the cloth introducing portion, runs horizontally while forming a vertical side face following the convex form of the convex front edge by being guided by vertical axis pulleys, and has many suction holes; a suction duct which is housed inside the suction belt, and whose face in contact with the convex vertical face of the suction belt is open; a discharge pipe for discharging air from the suction duct; a suction blower; a motor for driving the suction belt; a cloth detection sensor installed along the cloth side edge pull-in line on the horizontal surface of the cloth introducing portion; and a control circuit which detects the deviation of the cloth side edge based on the signal generated by the cloth detection sensor, and issues a command for normal or reverse rotation and stopping of the motor to correct the position through which the cloth side edge passes.

Still further, the present invention provides a rectangular cloth spreading apparatus which is provided with a cloth side edge aligning mechanism comprising a suction belt conveyor which is installed at a position, which is covered by the cloth when the cloth is drawn, at the center of a cloth guide plate mounted between the convex front edge, which is the cloth introducing portion, and the mounting stand, driven in both the cloth drawing direction and the direction perpendicular to the cloth drawing direction, and has many suction holes; a suction duct which is installed at the lower part of the suction belt conveyor and whose upper part is open; a servomotor for driving the suction belt conveyor, which has a brake and can rotate in the normal and reverse directions; a cloth detection sensor installed on the cloth side edge pull-in line on the cloth guide plate; and a control circuit which detects the deviation of the cloth side edge based on the signal generated by the cloth detection sensor, and issues a command for normal or reverse rotation and stopping of the motor with a brake to correct the position through which the cloth side edge passes.

The operation of each mechanism and means described above will be described independently below.

The rectangular cloth is pulled on the mounting stand while its half surface on the cloth edge side of the cloth running surface is sucked by many holes formed in the mounting stand. Therefore, only the cloth edge is subjected to frictional resistance in the drawing direction, so that the cloth is kept in parallel to the tractive direction. The cloth edge can be placed on the mounting stand so as to have a tension from the corner gripped by the gripping device to the end edge, so that the cloth is sent to the ironer, which is the following process, while keeping this condition, by which the finish quality of sheets, etc. can be kept good. Further, during the time when the rectangular cloth moves on the mounting stand, the sensor detects the timing of the passing position, the timing of centering is calculated, and the cloth is released from the gripping device, so that the time loss does not occur in this process.

When the rectangular cloth is pulled on the mounting stand, the cloth passing through a position near the convex front edge is brought together, and pushed up by the air blown from a plurality of nozzles located on the upstream side of the aforementioned front edge. Therefore, the frictional resistance of cloth near the aforementioned front edge decreases. When the movement of the rectangular cloth ends, the cloth corner which is brought together at the convex front edge and hangs down like a tail, being small in area and light in weight, is blown up by the air blown from the nozzle holes, and placed at a predetermined position on the mounting stand by being guided by the guide plate. Therefore, the cloth corner which is caught by the structure does not interfere with the next cloth feeding process.

Next, the operation of the cloth side edge aligning mechanism constituted by arranging the aforementioned belt moving/stopping units in line will be described. After the cloth is drawn onto the mounting stand, at the stage at which the belt conveyor is driven and the cloth is sent to the following process, the presence of the cloth is detected by the sensor installed on each belt moving/stopping unit. When the cloth has passed and a signal indicative of the absence of cloth is generated and sent to the control circuit, the control circuit operates the pneumatic actuator, so that the tension pulley is released from the conveyor belt, and the brake is applied to stop the conveyor.

After the signals generated by all sensors on the belt moving/stopping units for all conveyor belts indicate the absence of cloth, and it is checked that the whole cloth side edge is aligned at a specified position on the conveyor belt, the brakes are released simultaneously, so that all conveyor belts moves to deliver the cloth.

Next, the operation of the cloth side edge aligning mechanism using the suction belt will be described. The suction belt is installed at the lower part of the aforementioned convex front edge and mounting stand and runs horizontally while forming the vertical side face following the convex form of the convex front edge by being guided by the vertical axis pulleys. In the process in which the cloth is pulled to the cloth introducing portion of the cloth spreading apparatus by being gripped by the gripping device, the cloth detection sensor installed on the horizontal surface of the cloth introducing portion senses to determine that the side edge of the cloth being drawn deviates to the inside or the outside from the correct pull-in line. The detection signal activates the control circuit to laterally move the suction belt so that the cloth side edge aligns with the correct pull-in line.

When the cloth detection sensor determines that the cloth side edge has been corrected so as to align with the correct pull-in line during the lateral movement of cloth, the detection signal activates the control circuit to release the brake of the suction belt. The suction force of the suction belt increases the drawing of cloth at the convex front edge, improves the linearity of cloth in the drawing direction, and smooths out wrinkles of the cloth.

The operation of cloth side edge aligning means using the suction conveyor, which is installed between the aforementioned convex front edge and mounting stand and driven in both the cloth drawing direction and the direction perpendicular to the cloth drawing direction, will be described.-In the process in which the cloth is drawn on the cloth guide plate while being gripped by the gripping device, the cloth detection sensor installed on the cloth guide plate senses to determine whether the side edge of cloth being drawn deviates to the inside or the outside from the correct pull-in line. The detection signal activates the control circuit to attract the cloth to the suction belt conveyor and moves it laterally so that the cloth side edge aligns with the correct pull-in line. When the cloth detection sensor determines that the cloth side edge has been corrected so as to align with the correct pull-in line during the lateral movement of cloth, the detection signal activates the control circuit to stop the movement of the suction belt conveyor. Also, the wrinkles of the cloth portion which is not on the suction belt conveyor are smoothed out.

As described above, according to the present invention, the side edge of a rectangular cloth can be drawn straight in the drawing direction by using a simple and inexpensive construction. Moreover, the need for the process in which the side edge of the cloth is realigned is eliminated, so that the cycle time of the cloth spreading process can be shortened. Further, the cloth side edge can be held straight in the tensioned condition. As a result, the occurrence of wrinkles is eliminated and the finish quality of cloth on the ironer, which is the subsequent process, can be improved.

If the cloth is deformed, the cloth side edge remains oblique and does not align with the line perpendicular to the conveyor feeding direction even when a pull resistance is given to the cloth by means of the suction duct forming the mounting stand. By using the cloth side edge aligning mounting stand which is composed by arranging the belt moving/stopping units in line laterally each of which comprises the tension pulley and brake for conveyor belt and the cloth detection sensor, in accordance with the present invention, the cloth side edge can be aligned in the direction perpendicular to the conveyor feeding direction directly on the mounting stand and sent as it is by means of the conveyor belt. Therefore, the pressing of the cloth side edge can be reliably performed for spreading of the cloth in the following process. Also, according to the present invention, the loss of time for adjustment is completely eliminated because the aligning work is performed in the delivery process using the conveyor belt.

According to the present invention, the cloth side edge is corrected to the correct pull-in line at the initial stage of drawing by using the cloth side edge aligning mechanism using the suction belt which is disposed under the convex front edge and the mounting stand and driven in the direction perpendicular to the cloth drawing direction, so that the direction in which the side edge of the cloth on the mounting stand is pulled becomes more accurate. This mechanism also performs the function of smoothing out the wrinkles of the cloth.

Further, according to the present invention, the side edge of the cloth being drawn is corrected to the correct pull-in line by the cloth side edge aligning mechanism using the suction belt conveyor which is disposed between the convex front edge and the mounting stand and driven in the direction perpendicular to the cloth drawing direction, so that the side edge of the cloth placed on the mounting stand is placed on a straight line perpendicular to the conveyor belt feeding direction. Also, the wrinkles of the cloth portion which is not placed on the suction belt conveyor can be smoothed out.

DETAILED DESCRIPTION OF PREFERRED EMBODIMENTS

Figure 1:
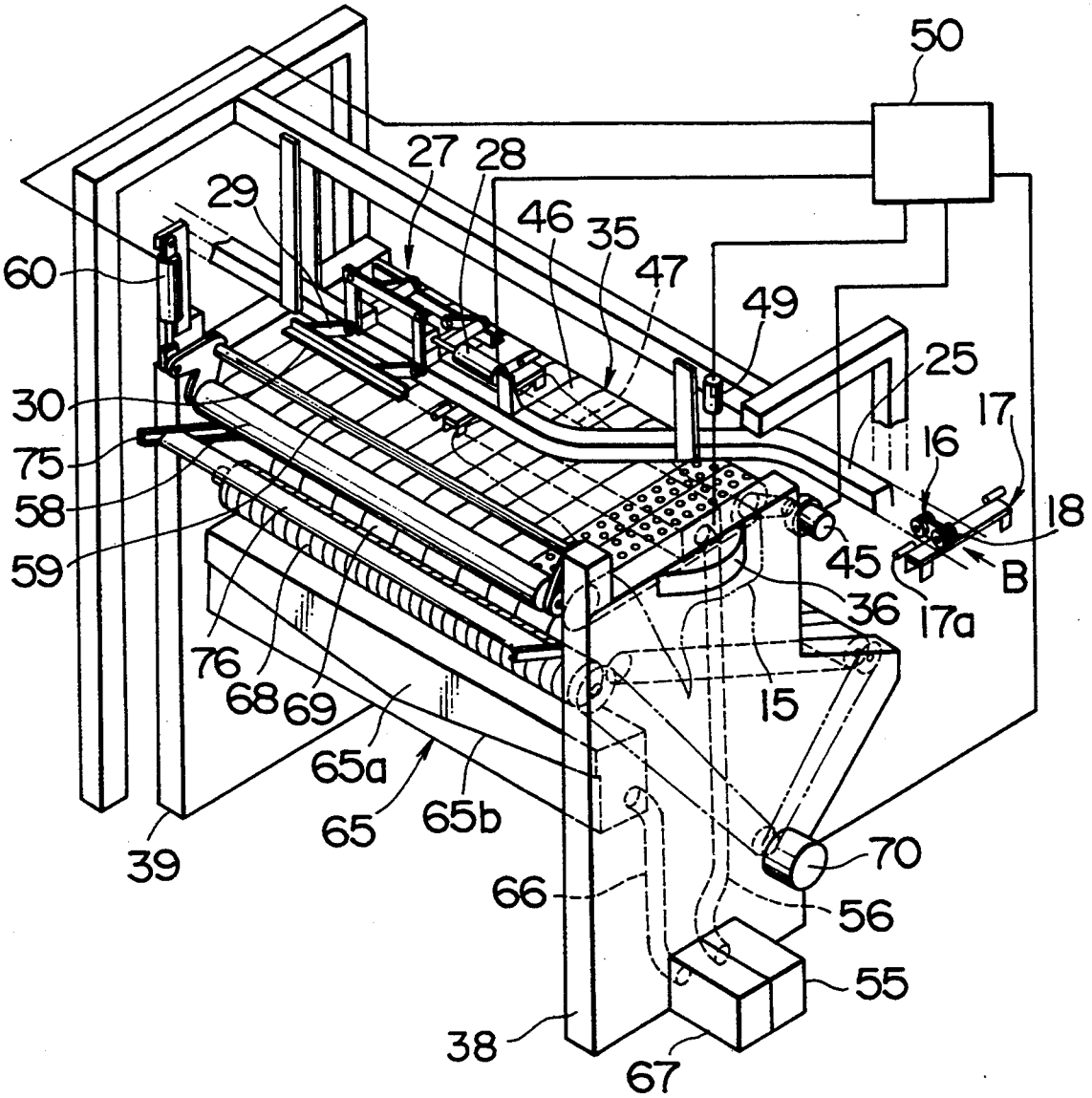
FIG. 1 is a perspective view of an apparatus for spreading a rectangular cloth in accordance with one embodiment of the present invention.
Figure 33:
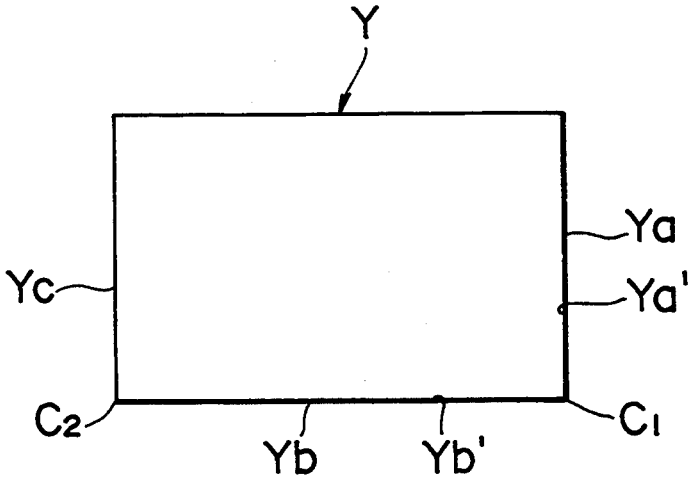
FIG. 33 is an expanded view of a rectangular cloth handled by the apparatus for spreading a rectangular cloth.

One embodiment of the present invention shown in the drawings will be described below. FIGS. 1 to 13 show one embodiment of the present invention. FIG. 1 is a perspective view showing the entire apparatus for spreading sheets. First, the entire spreading apparatus will be described focused on a mounting stand having a suction duct, and a sheet blowing nozzle mechanism will be described with reference to FIGS. 1 to 6. Next, a belt moving/stopping unit, which is a sheet side edge aligning mechanism on the mounting stand, will be described with reference to FIGS. 7 to 9, and a suction conveyor mechanism, which is installed at the sheet introducing portion and moves laterally, will be described with reference to FIGS. 10 to 13. The symbols indicating the corners and edges of a sheet 15 are the same as shown in FIG. 33.

In FIGS. 1 to 6, any corner $C_1$ and the edge $Y_a$ including the corner $C_1$ of the sheet 15 are manually gripped by two clips 17 installed on a gripping device 16 with a distance of shoulder width. The gripping device 16 runs in a guide rail 25 by means of four wheels 18, and is driven by means of a not illustrated chain driving means via a chain 26 engaging with a rack installed above. The gripping device also can move freely on the inclined guide rail by releasing the engagement with the chain 26. For the arms supporting the clips 17 of the gripping device 16, the arm 16*a* on the corner $C_1$ side is long, and the arm 16*b* on the edge $Y_a$ side is short. The reason for this is that when the sheet 15 gripped by the gripping device 16 hangs down naturally, the load on the clip 17 is higher on the arm 16*b* side.

The gripping device 16 hanging the sheet 15 moves on the guide rail 25 by being driven by the chain 26, and advances onto the spreading apparatus in the direction of the arrow B in FIG. 1. The sheet 15 is pulled on the mounting stand 35 while being spread at a convex front edge 36. The gripping device 16 advances over the mounting stand 35, and releases the sheet 15 by means of a clip gripping release mechanism 27 at the position at which the side edge $Y_b$ has ridden on the mounting stand 35. Specifically, in the clip gripping release mechanism 27, a pneumatic actuator 28 is operated, and a lever 29 is rotated so that a push plate 30 pushes a release arm 17*a* of the clip 17, by which the sheet 15 is released as described above.

Figure 2:
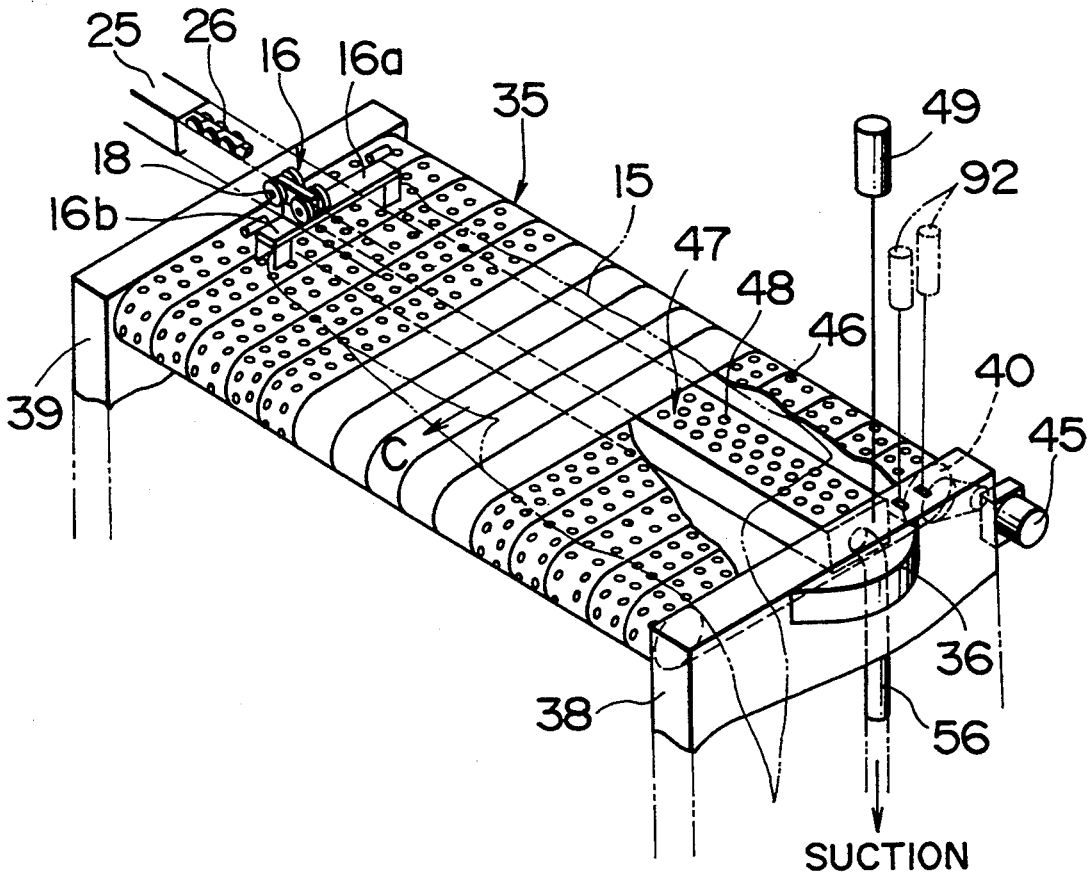
FIG. 2 is a perspective view of a cloth mounting stand shown in FIG. 1.

FIG. 2 is a perspective view showing the construction of the mounting stand 35. The main part of the mounting stand 35 consists of many flat belts 46 set around pulleys 40 which are supported by frames 38 and 39 at both sides and intermittently driven by a motor 45. These flat belts 46 have many small holes formed on the whole surface. Alternatively, a net belt of a large mesh, which easily allows air to pass, may be used. At the central portion of the mounting stand 35, belts without holes may be used.

A suction duct 47 is installed in contact with the inner surface of the flat belt 46 and throughout the total width of the mounting stand 35. The upper surface of the suction duct 47, that is, the surface in contact with the flat belt 46, has many small holes 48. Corresponding to the flat belt 46 at the central portion of the mounting stand 35, the suction duct 47 at the central portion need not have small holes 48. A photoelectric sensor 49 is installed over the frame 38. This sensor 49 detects the passage of the gripping device 16 and the passage of the end edge $Y_c$ of the sheet 15. The signal generated by this sensor 49 is sent to a controller 50 for processing.

Figure 3:
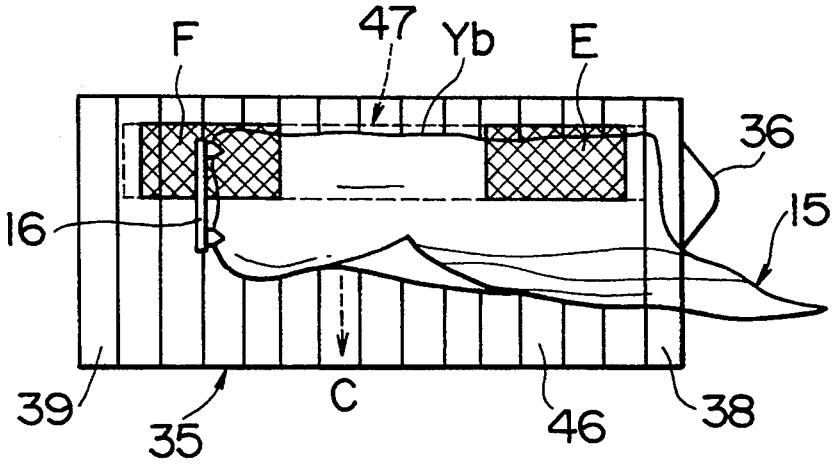
FIG. 3 is a plan view of the cloth mounting stand shown in FIG. 2.

FIG. 3 is a plan view of the mounting stand 35, showing the relationship between the position of the sheet 15 which is drawn and placed and the position of the group of suction holes 48 of the suction duct 47. As shown in the figure, the range in which suction of the suction duct 47 is effective is portions indicated by symbols E and F divided into the front and rear in the advance direction of the sheet 15 on the side edge $Y_b$ side of the sheet at the half portion of the touching surface of the drawn sheet 15. The range where suction is effective may be over the total length of the touching surface of the sheet 15. In this case, however, the drawing resistance of the sheet 15 becomes excessive. The suction duct 47 is connected to a suction blower 55 through a pipe 56 (see FIG. 4).

Figure 5:
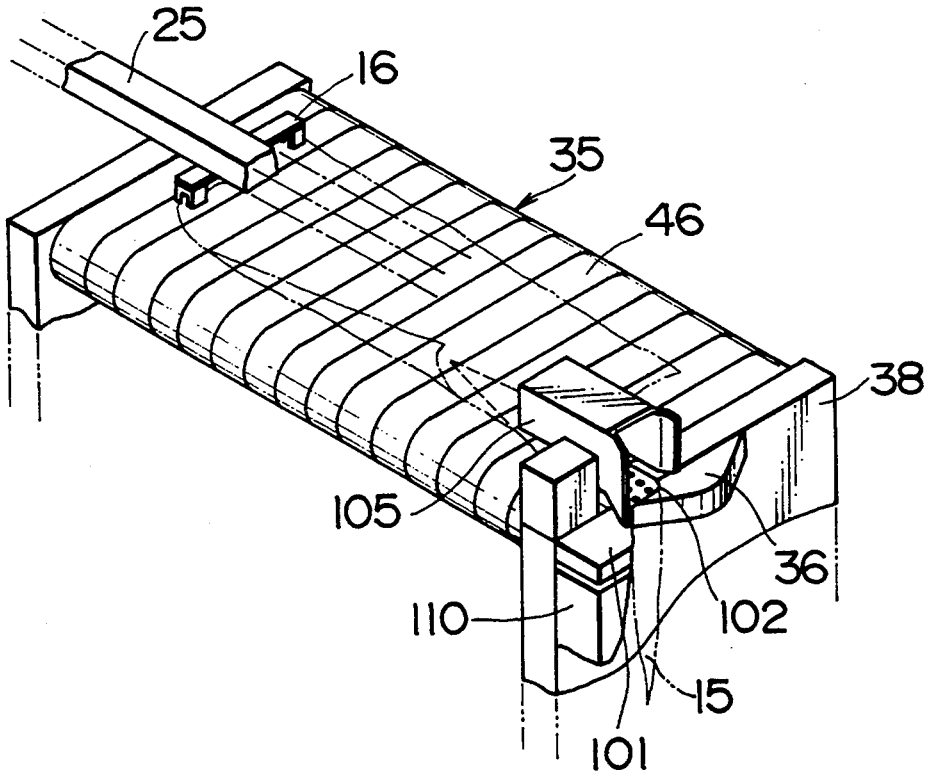
FIG. 5 is a perspective view of a cloth corner blowing nozzle mechanism in accordance with one embodiment of the present invention.

Next, the construction of a sheet blowing nozzle mechanism will be described with reference to FIGS. 5 and 6.

A concave front edge 101 is installed to the frame 38 following the convex front edge 36 of the sheet introducing portion of the mounting stand 35. A nozzle box 102 is installed at the upper part of the frame 38 in agreement with the concave centerline of the concave front edge 101. The top surface of the nozzle box 102 is flush with the top surface of the mounting stand 35. On the top surface of the nozzle box 102, a plurality of nozzle holes 103 are formed to blow air at an angle to the movement direction of the sheet 15. Air is supplied from a not illustrated air source to the nozzle box 102 through an air supply pipe 104.

Above the nozzle box 102 is provided a guide plate 105 for guiding the tail-shaped corner of the sheet 15 blown up by the air blown from the nozzle holes 103 so that the corner is surely turned over on the mounting stand 35 and placed at a predetermined position. If a guide box 110 is installed under the concave front edge 101, the movement of the tail-shaped portion of the sheet 15 can be restricted when a long-size sheet 15 is moved, by which stability is increased.

Figure 4:
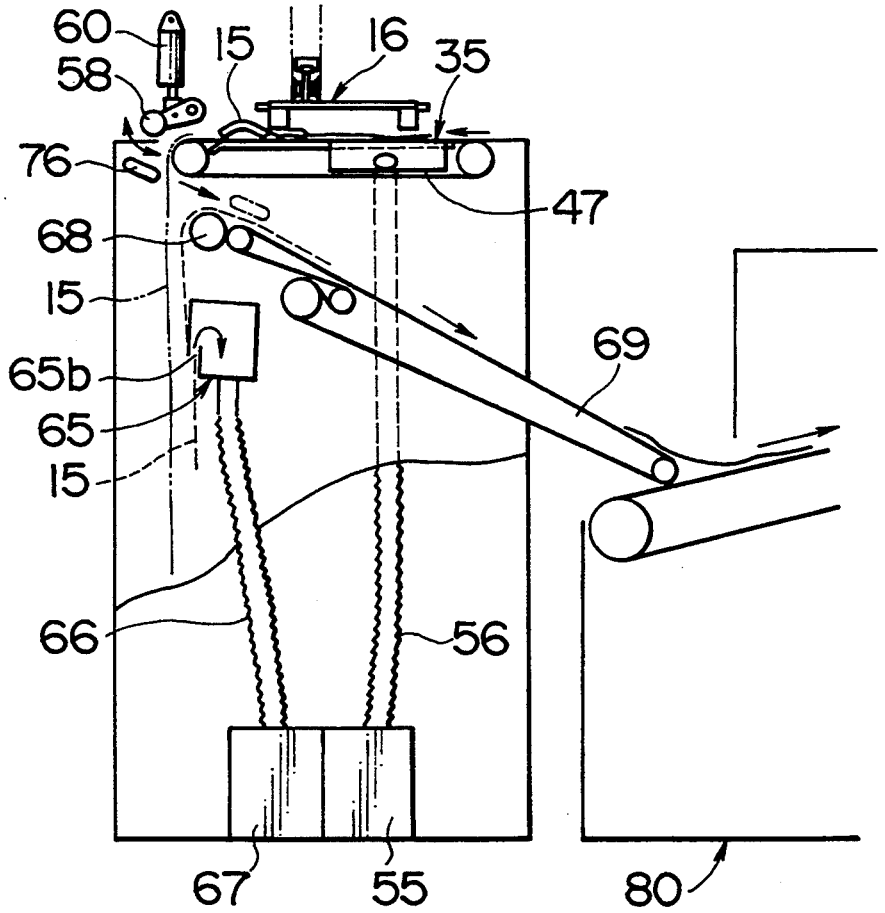
FIG. 4 is a side sectional view of the cloth spreading apparatus shown in FIG. 1.

FIG. 4 is a side sectional view of the spreading apparatus. Here, the construction of the spreading mechanism for the whole sheet 15 will be described with reference to FIGS. 1 and 4. A roller 58 is installed at the outlet of the conveyor consisting of flat belts 46 of the mounting stand 35. The roller 58 is revolved around a shaft 59 by the operation of the pneumatic actuator 60 so as to press or release the flat belts 46.

A vacuum type air spreader 65 is installed on the frames 38 and 39. A downward convex spreading plate 65*a* is installed at the front edge of the air spreader 65, so that the sheet 15 is attracted by the downward suction slit 65*b*; therefore, the function of the convex spreading plate 65*a* can be fully achieved. The air spreader 65 is also connected to a suction blower 67 through a pipe 66.

Under the mounting stand 35, a friction roller 68 which is driven by the same motor 70 and a delivery conveyor 69 which runs in the oblique lower direction to deliver the sheet 15 are installed. Reference numeral 76 denotes an introducing bar which is guided by the guides 75 installed on the frames 38 and 39. The introducing bar 76 is intermittently driven by a not illustrated chain, and reciprocates by being guided by the guide 75 by means of a not illustrated link mechanism connecting one place of the chain to the introducing bar 76.

Next, the operation of the embodiment of the spreading apparatus constituted as described above will be described. When the sheet 15 is drawn on the mounting stand 35 while the corner $C_1$ and the edge $Y_a$ of the sheet 15 are gripped by the clips 17 of the gripping device 16, and the sheet 15 is subjected to frictional resistance at the convex front edge 36, without a suction force, the side edge $Y_b$ of the sheet 15 is pushed by other portions of the sheet 15, and the entire form of the sheet 15 spreads out like an unfolded fan.

However, by installing the suction duct 47 in accordance with the present invention, the side edge $Y_b$ of the sheet 15 is attracted at the portion E shown in FIG. 3, so that the frictional resistance at this portion increases, by which the tension force of the side edge $Y_b$ of the sheet 15 increases. Therefore, the other portions of the sheet 15 are pushed back, and the side edge $Y_b$ is drawn straight and always with a tension. The suction portion indicated by F on the mounting stand 35 is effective in keeping a tensioned condition of the side edge $Y_b$ when the sheet 15 is released from the clips 17 and placed on the mounting stand 35. Without the suction portion indicated by F, the side edge $Y_b$ of the sheet 15 shrinks at the same time it is released from the clips 17, so that wrinkles occur easily.

When the sheet 15 advances onto the mounting stand 35 while being gripped by the clips 17 of the gripping device 16, the photoelectric sensor 49 detects the gripping device 16 and the end edge $Y_c$, and sends a signal to the controller 50. The controller 50 calculates the timing of passage of the gripping device 16 and the end edge $Y_c$ and the timing of centering of the sheet 15 with respect to the mounting stand from the traveling speed of the gripping device 16 to operate the pneumatic actuator 28, so that the clip gripping release mechanism 27 is operated to release the sheet 15.

In the case where the sheet 15 is of a long rectangular shape, if the sheet 15 is wet when the sheet is drawn on the mounting stand 35, its weight is heavy, and part of the sheet 15 is brought together and hangs down like a tail even when the movement is ended. However, when the sheet 15 passes through the concave front edge 101, the sheet 15 is brought together and pushed up by the air blown from the nozzle holes 103, so that the sheet 15 in the vicinity of the concave front edge 101 floats, by which the frictional resistance of the sheet 15 to the pulling decreases.

Figure 6:
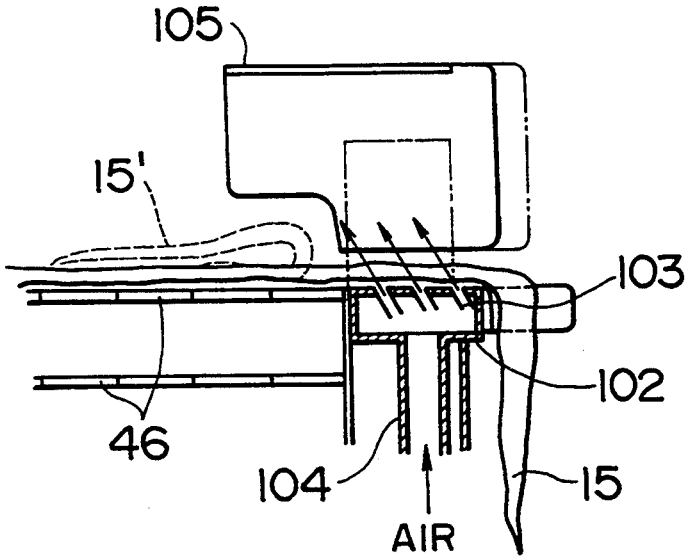
FIG. 6 is a front sectional view of the nozzle mechanism shown in FIG. 5.

Since the remaining corner $C_2$ of the sheet 15 is small in area and light in weight, it is blown up by the air blown from the nozzle holes 103 in the direction indicated by the arrows in FIG. 6, and guided by the guide plate 105, so that it is turned over like the sheet 15' indicated by the broken line in FIG. 6, and can be placed at a predetermined position on the mounting stand 35. Therefore, the corner $C_2$ of the sheet 15 does not interfere with the following sheet feeding process by being caught by the frame or the guide rail 25 of the gripping device 16.

The sheet 15 placed on the mounting stand 35 is moved in the direction of the arrow C in FIGS. 2 and 3 by the flat belts 46 driven by the motor 45, and stops when the side edge $Y_b$ reaches the position just before the roller 58. Other portions of the sheet 15 hang down naturally from the end of the flat belts 46 (the position of the sheet 15 indicated by the two-dot chain line in FIG. 4).

Then, the sheet 15 is pushed onto the friction roller 68 and the delivery conveyor 69 by the operation of the introducing bar 76 (the position of the sheet 15 indicated by the broken line in FIG. 4), so that the sheet 15 is sent to the ironer 80 of the following process by means of the delivery conveyor 69 while being spread by the air spreader 65 and the friction roller 68.

Although the spreading of a rectangular cloth has been explained in this embodiment of the present invention, the present invention can be applied to a square cloth without trouble. In this embodiment, an example in which any corner $C_1$ and the edge $Y_a$ including the corner $C_1$ of the sheet 15 is gripped was explained, but part of the longer side edge (for example, $C_1$ and $Y_b'$ in FIG. 33) may be gripped. In this case, the shorter side edge of the sheet 15 (the edge indicated by $Y_a$ in FIG. 33) is aligned.

Figure 7:
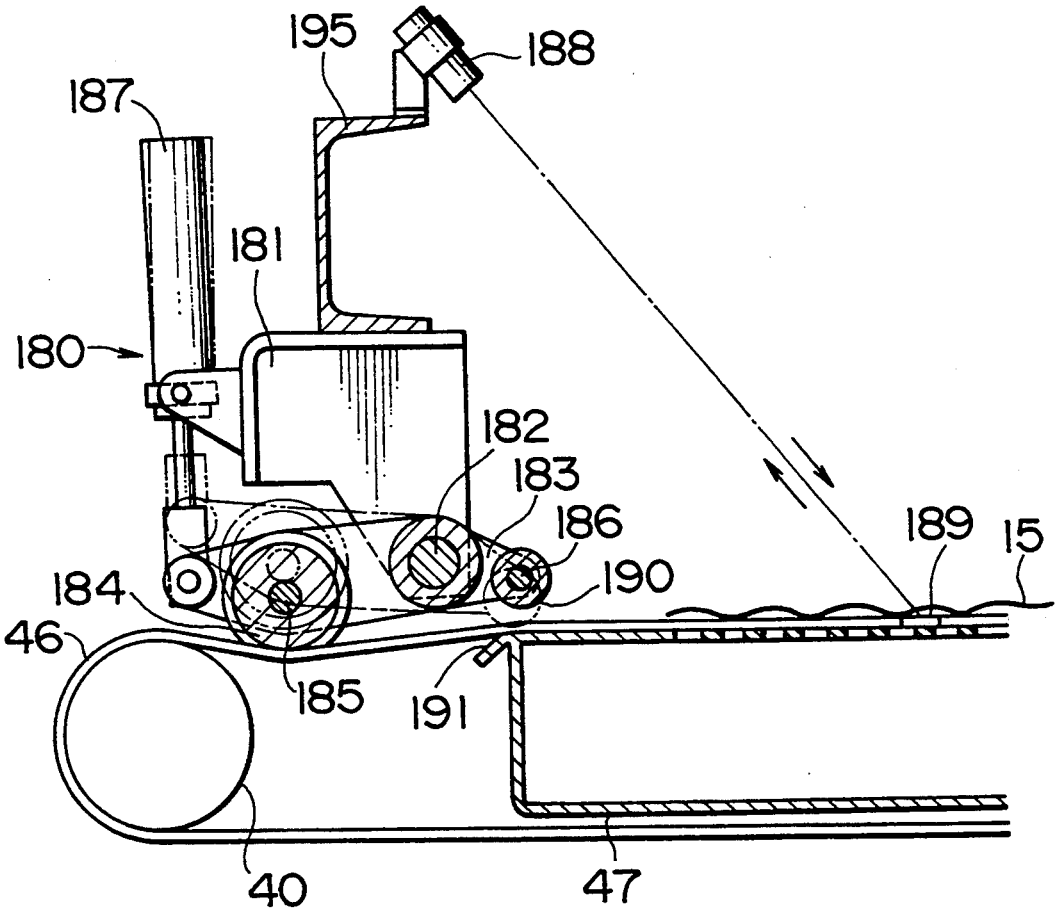
FIG. 7 is a side sectional view of a cloth side edge aligning mounting stand with belt moving/stopping units in accordance with one embodiment of the present invention.
Figure 8:
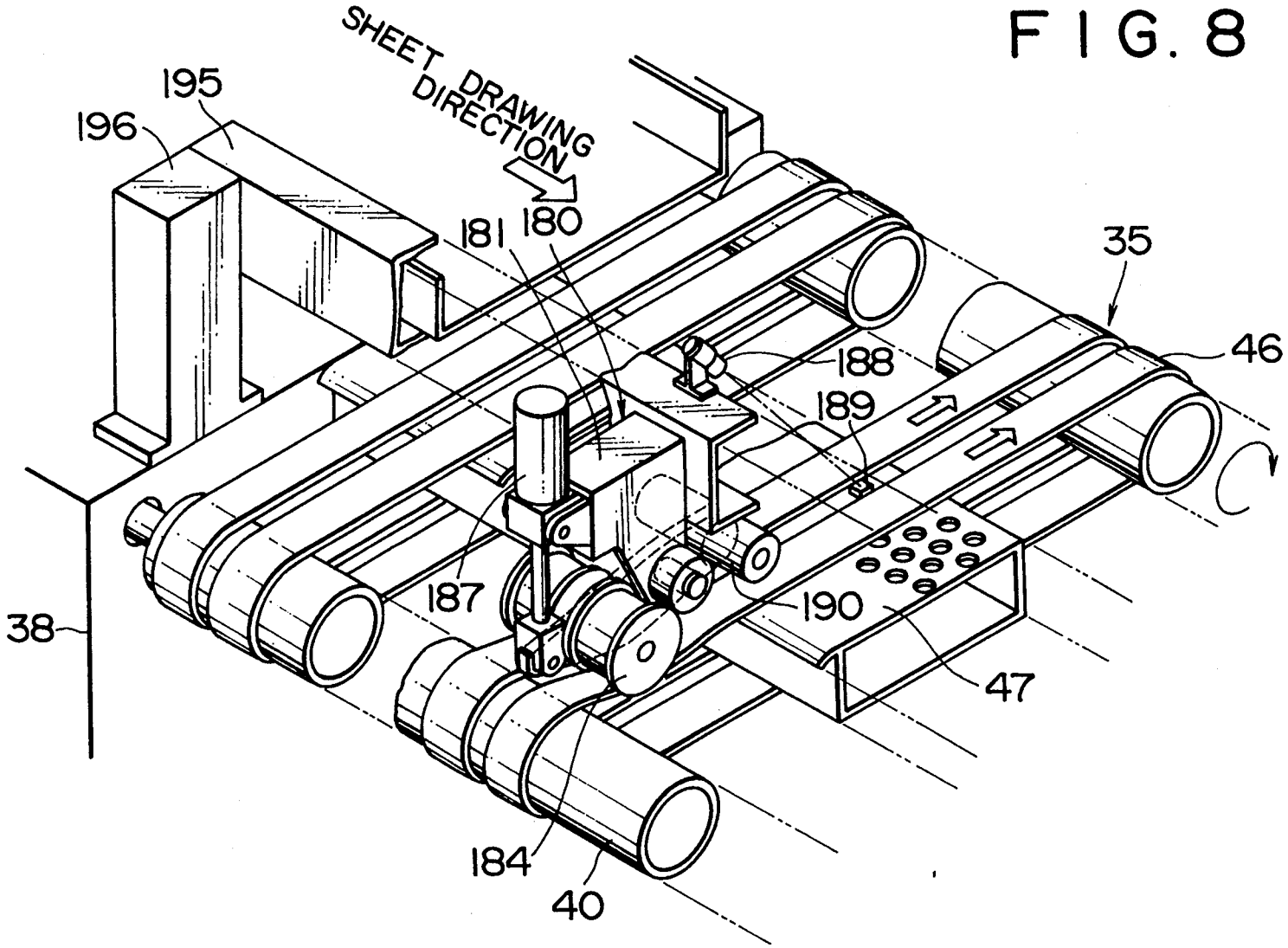
FIG. 8 is a perspective view of a belt moving/stopping unit on the cloth side edge aligning mounting stand shown in FIG. 7.
Figure 9:
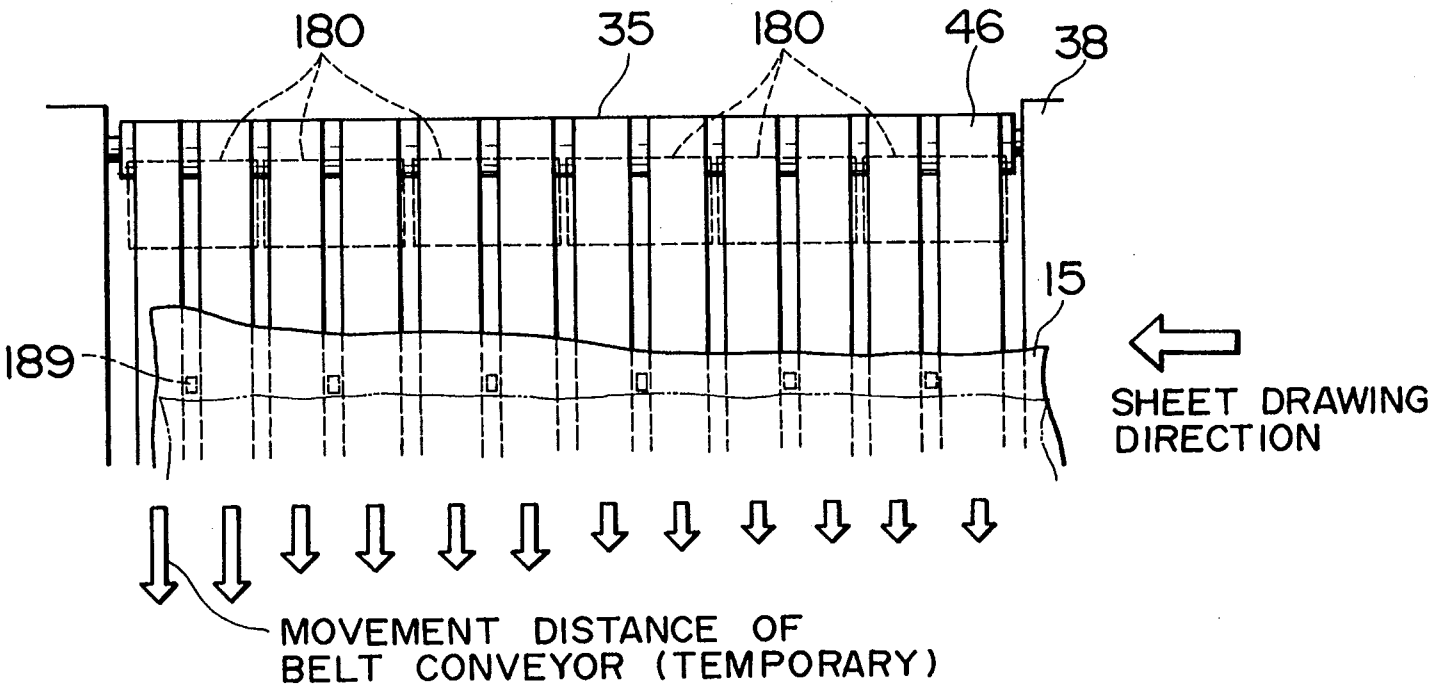
FIG. 9 is a plan view for illustrating the operation of the cloth side edge aligning mounting stand shown in FIG. 7.
Figure 10:
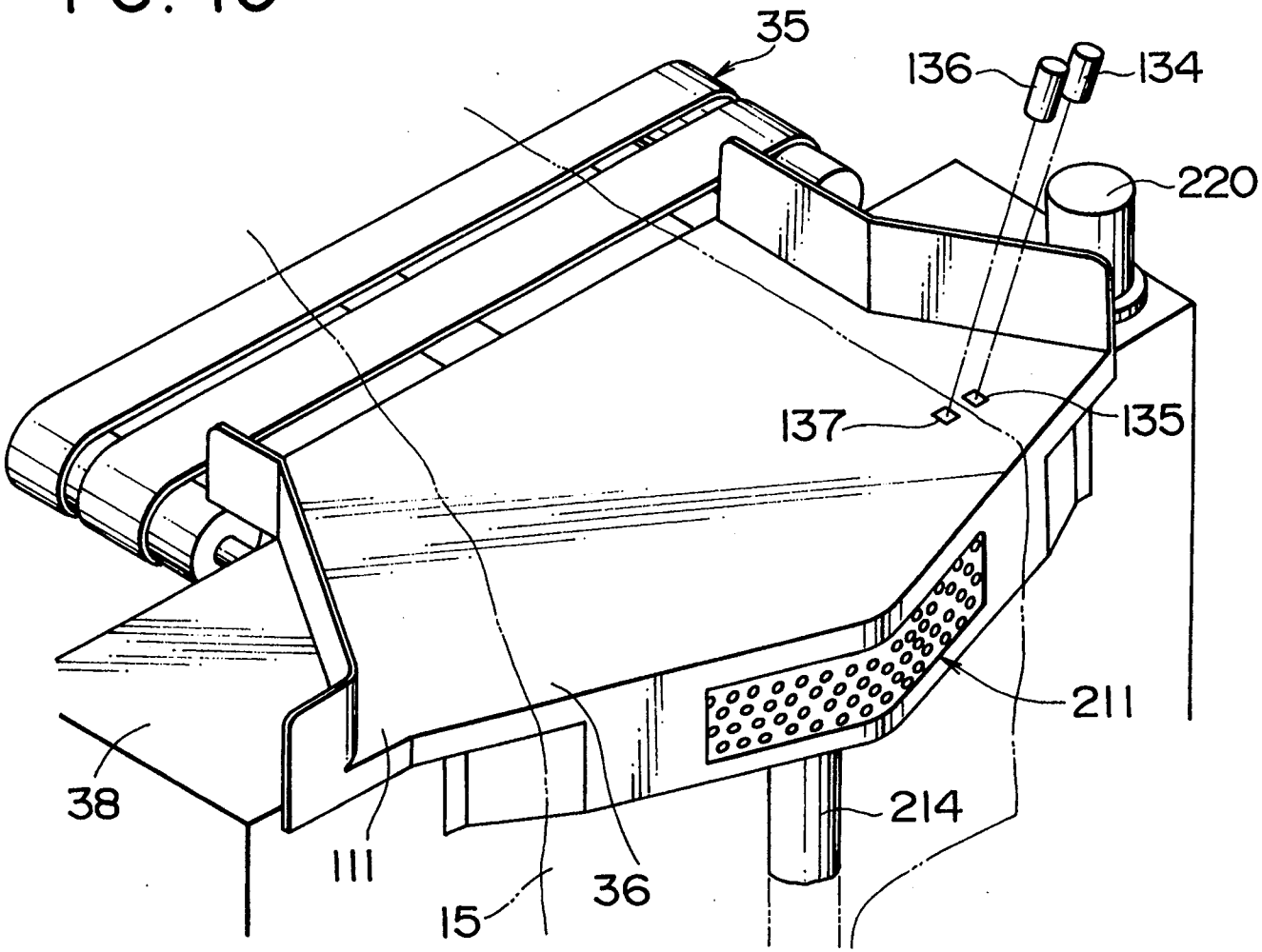
FIG. 10 is a perspective view of a cloth side edge aligning mechanism using a suction conveyor in accordance with one embodiment of the present invention.
Figure 11:
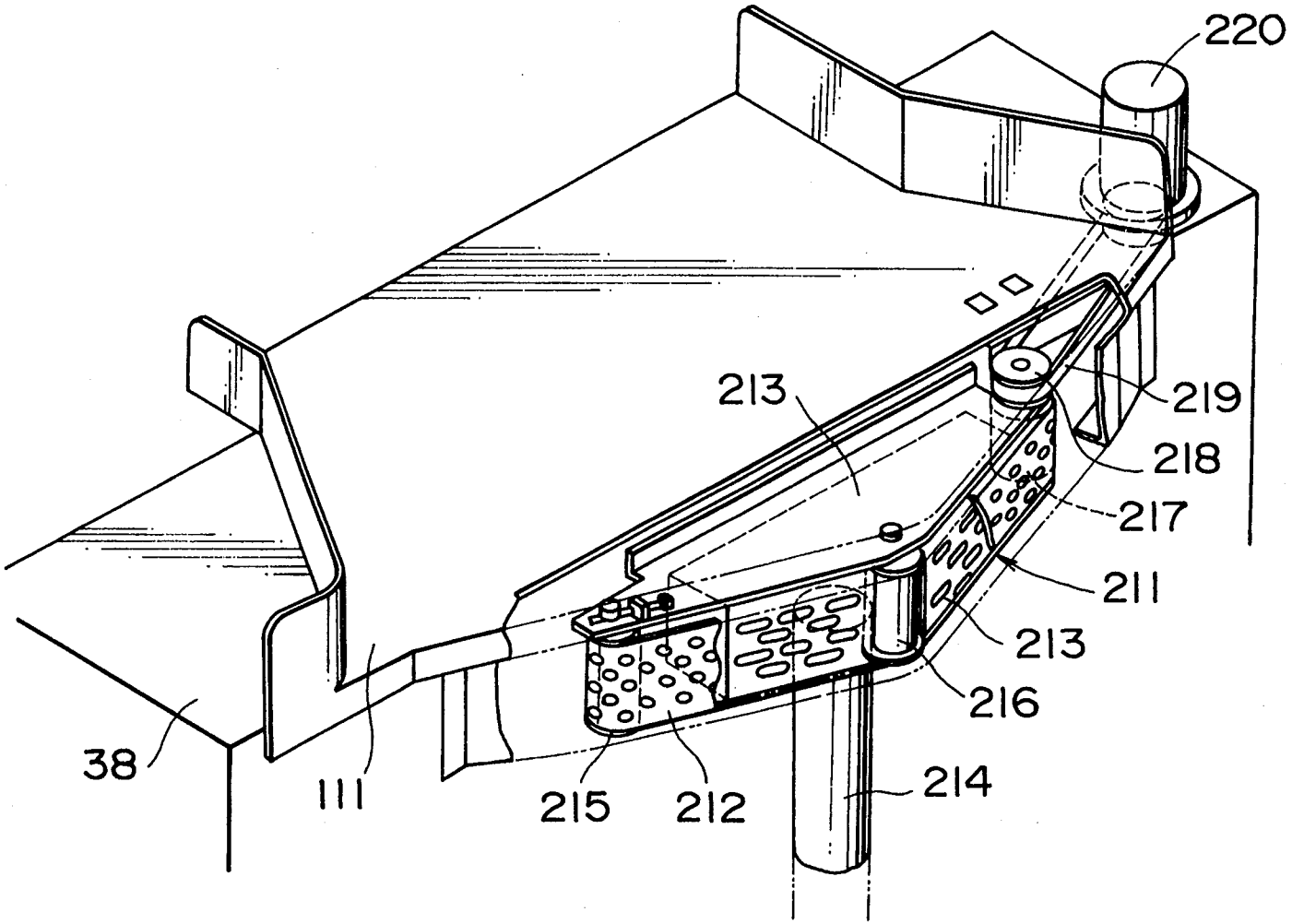
FIG. 11 is a perspective view showing the detailed construction of the suction conveyor shown in FIG. 10.

Next, an embodiment of a sheet side edge aligning mounting stand which is constituted by arranging the belt moving/stopping units in line will be described with reference to FIG. 7 to 9. FIG. 7 is a sectional view of a belt moving/stopping unit 180, FIG. 8 is a perspective view of the belt moving/stopping unit 180 installed on the mounting stand 35, and FIG. 9 is a view for illustrating the operation of the belt moving/stopping unit 180.

In the figures, many belt moving/stopping units 180 are arranged in line on a horizontal beam 195, which is fixed to the frame 38 via a column 196. A fixed shaft 182 is fixed to a unit base 181 installed to the horizontal beam 195. To the fixed shaft 182 is rotatably fitted an operating lever 183. A pair of tension pulleys 184 are rotatably fitted to a shaft 185 which is fixed to the operating lever 183 and protrudes from both sides of the operating lever 183, whereas a pair of brake rollers 190 are rotatably fitted to a shaft 186 which is fixed to the operating lever 183 and protrudes from both sides of the operating lever 183.

The tension pulleys 184 and the brake rollers 190 have a function of driving and stopping two conveyor belts 46 at the same time. A pneumatic actuator 187 is rotatably connected to the unit base 181 with a pin, and the end of the operating lever 183 is connected to the operating rod of the pneumatic actuator 187 with a pin. The position indicated by the solid line in FIG. 7 at which the operating rod of the pneumatic actuator 187 extends denotes the condition where the brake rollers 190 are raised and the tension pulleys 184 are lowered to provide tension to the conveyor belts 46, and the rotation of the driving roller 40 is transmitted to the conveyor belts 46, so that the conveyor belts 46 are moved.

The position indicated by the two-dot chain line in FIG. 7 at which the operating rod of the pneumatic actuator 187 retracts denotes the condition where the tension pulleys 184 are raised so that no tension is applied to the conveyor belts 46, by which the conveyor belts 46 are loosened, and the brake rollers 190 press the conveyor belts 46 against a brake plate 191 to apply brake, thereby the conveyor belts 46 being stopped.

A photoelectric sensor 188, which is also used as a light source, is installed on the horizontal beam 195 over the unit base 181, and a reflection plate 189 for reflecting the light source beam of the photoelectric sensor 188 is installed at the position of gap between a pair of conveyor belts 46 on the top surface of the suction duct 47 installed under the conveyor belts 46. The photoelectric sensor 188 and the reflection plate 189 detect the passage of the side edge of the sheet 15 carried by the running of the belts 46. Although not shown in the figures, a control circuit is installed to appropriately issue a command to the pneumatic actuator 187 by receiving the detection signal indicative of the presence of the sheet 15 generated by the photoelectric sensor 188 for each unit.

Next, the operation of the sheet side edge aligning mounting stand constituted by the aforementioned belt moving/stopping units 180 will be described. After the sheet 15 is drawn onto the mounting stand 35 (the solid line in FIG. 9 indicates the position of the sheet 15 immediately after the sheet 15 is drawn), at the stage at which the conveyor belts 46 are driven and the sheet 15 is sent to the following process, the presence of the sheet 15 is detected by the photoelectric sensor 188 installed on each belt moving/stopping unit and the reflection plate 189. If the sheet 15 has passed and a signal indicative of the absence of the sheet is generated and sent to the control circuit, the control circuit activates the pneumatic actuator 187 to separate the tension pulleys 184 from the conveyor belts 46 and to apply brake, thereby the conveyor belts 46 being stopped (the two-dot chain line indicates the position at which the sheet 15 is stopped just behind the reflection plates 189 by the belt moving/stopping units 180).

When the side edge of the sheet 15 is aligned at a specified position on the conveyor belts 46 and the signals generated by the sensors 188 of all belt moving/-stopping units indicate the absence of the sheet, the control circuit issues a command to release the brakes simultaneously, so that all the conveyor belts 46 are moved to send out the sheet 15. In the actual operation, the sheet 15 which is moved the longest distance by the conveyor belts 46 (for example, the sheet 15 moved by the leftmost two rows of conveyor belts in FIG. 9) scarcely stops because a command is issued to move the conveyor belts 46 simultaneously as soon as the brake is applied when the photoelectric sensor 188 and the reflection plate 189 detect the passage of the sheet 15.

Next, an embodiment of a cloth side edge aligning mechanism using a suction belt which is disposed at the lower part of the convex front edge of the present invention and driven at right angles to the sheet drawing direction will be described with reference to FIGS. 10 to 13. First, the construction of a suction belt conveyor unit 211 will be described with reference to perspective view shown in FIGS. 10 and 11.

The suction belt conveyor unit 211 is installed on the frame 38 under the convex front edge 36, which is the sheet introducing portion. A suction belt conveyor 212, which is the main component of the suction belt conveyor unit 211 and has many suction holes, is guided by three flanged vertical axis pulleys 215,216, and 217, and runs horizontally while forming a vertical side face following the convex form of the convex front edge. Therefore, the suction belt 212 is driven by a motor 220 via the vertical axis pulley 217, a driven pulley 218 which is fixed to the shaft of the pulley 217, and a drive belt 219.

A suction duct 213 is formed integrally with a frame supporting the shafts of the vertical axis pulleys 215, 216, and 217. The suction duct 213 is housed inside the suction belt 212, and has many elongated holes on its face in contact with the convex vertical face of the suction belt 212. The air in the suction duct 213 is discharged by a not illustrated suction blower through a discharge pipe 214 installed under the suction duct 213.

Photoelectric sensors 134 and 136, which are mounted on a fixed member (not shown) and used also as light sources, are installed at both sides of the sheet side edge pull-in line on a sheet guide plate 111 over the frame 38, and, in combination with reflection plates 135 and 137, make detection to determine whether the side edge of the sheet 15 lies within the allowable width along the correct sheet pull-in line. The not illustrated control circuit detects the deviation of the sheet side edge on the basis of the signal generated by the photoelectric sensors 134 and 136, and gives the motor 220 a command for normal or reverse rotation and stopping to correct the position through which the cloth side edge passes.

When the sheet 15 is deformed, the corner of the sheet 15 gripped by the gripping device 16 has an acute angle, and the side edge of the drawn sheet mostly deviates inside from the correct pull-in line. Only the inside combination of photoelectric sensor 136 and reflection plate 137 serves the purpose of aligning with the sheet pull-in line to some degree.

Figure 12:
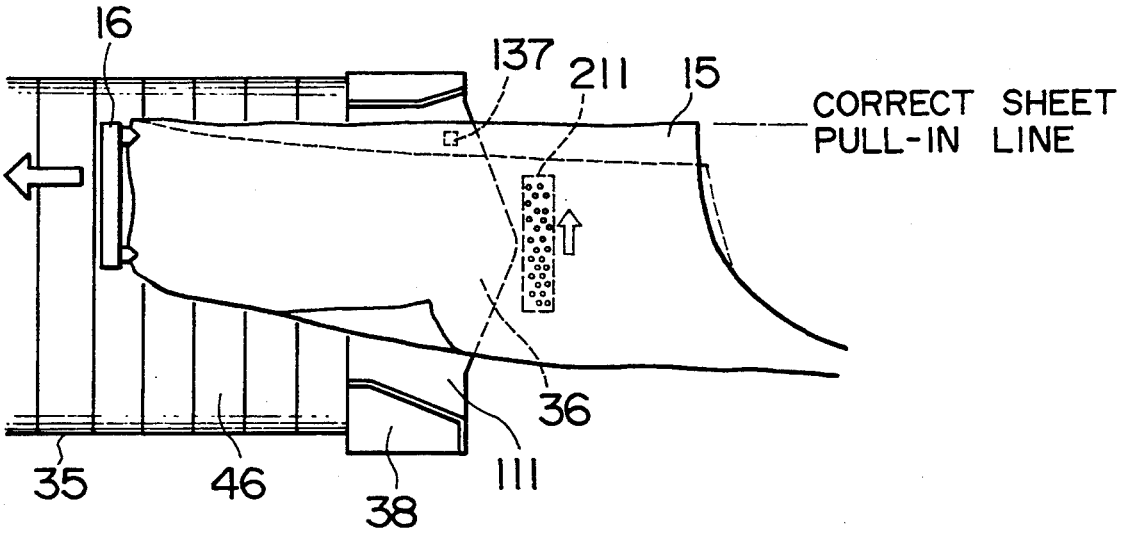
FIG. 12 is an expanded plan view of cloth flow, showing a first example of the operation of the cloth side edge aligning mechanism shown in FIG. 10.

A first example of the operation of the embodiment of the sheet side edge aligning mechanism using the aforementioned suction belt conveyor unit 211 will be described with reference to FIG. 12. In the example shown in FIG. 12, only one set of photoelectric sensor 136 and reflection plate 137 is used.

In the process in which the sheet 15 gripped by the gripping device 16 is drawn onto the sheet guide plate 111 and the mounting stand 35, the light source beam of the photoelectric sensor 136 hits on the reflection plate 137 installed on the sheet guide plate 111, so that detection is made to determine whether the side edge of the sheet 15 being drawn deviates inside from the correct pull-in line. If the photoelectric sensor 136 detects the light reflected by the reflection plate 137, the sheet 15 deviates inside as indicated by the broken line in FIG. 12. Therefore, the detection signal activates the control circuit to attract the sheet 15 to the suction belt 212 and laterally move the sheet 15 in the outside direction (the arrow direction) so that the sheet side edge aligns with the correct pull-in line indicated by the solid line.

When the sheet side edge comes within the allowable width along the correct pull-in line during the lateral movement of the sheet 15, the sheet 15 intercepts the light source beam of the photoelectric sensor 136, so that the photoelectric sensor 136 detects the presence of the sheet 15, and the detection signal stops the movement of the suction belt 212.

Figure 13:
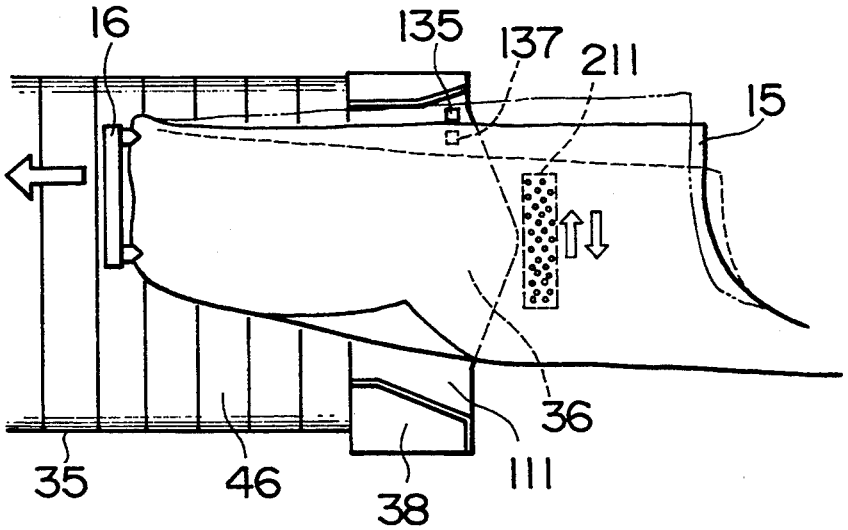
FIG. 13 is an expanded plan view of cloth flow, showing a second example of the operation of the cloth side edge aligning mechanism shown in FIG. 10.

FIG. 13 shows a second example of the operation of the sheet edge aligning mechanism in the case where two sets of the photoelectric sensors 134 and 136 and the reflection plates 135 and 137 are used in combination. In the process in which the sheet 15 gripped by the gripping device 16 is drawn onto the sheet guide plate 111 and the mounting stand 35, the photoelectric sensors 134 and 136 and the reflection plates 135 and 137 installed on the sheet guide plate 111 make detection to determine to which side of the inside and the outside from the allowable width along the correct pull-in line the side edge of the sheet 15 being drawn deviates.

If both the photoelectric sensors 134 and 136 detect the presence of the sheet 15, the sheet 15 deviates outside as indicated by the two-dot chain line in FIG. 13. In this case, the detection signal activates the control circuit to attract the sheet 15 to the suction belt 212 and laterally move the sheet 15 in the inside direction (the downward arrow direction in FIG. 13) so that the sheet side edge aligns with the correct pull-in line indicated by the solid line. When the sheet side edge comes within the allowable width along the correct pull-in line during the lateral movement of the sheet 15, the photoelectric sensor 134 detects the absence of the sheet 15, and the detection signal stops the movement of the suction belt 212.

If neither the photoelectric sensor 134 nor 136 detect the sheet 15, the sheet 15 deviates inside as indicated by the broken line in FIG. 13. In this case, the detection signal activates the control circuit to attract the sheet 15 to the suction belt 212 and laterally move the sheet 15 in the outside direction (the upward arrow direction in FIG. 13) so that the sheet side edge aligns with the correct pull-in line.

When the sheet side edge comes within the allowable width along the correct pull-in line, the photoelectric sensor 136 detects the presence of the sheet 15, and the detection signal stops the movement of the suction belt 212.

The suction force of the suction belt 212 increases the drawing of the sheet 15 at the convex front edge 36, improves the linearity of the sheet 15 in the drawing direction, and smooths out wrinkles of the sheet 15.

Figure 14:
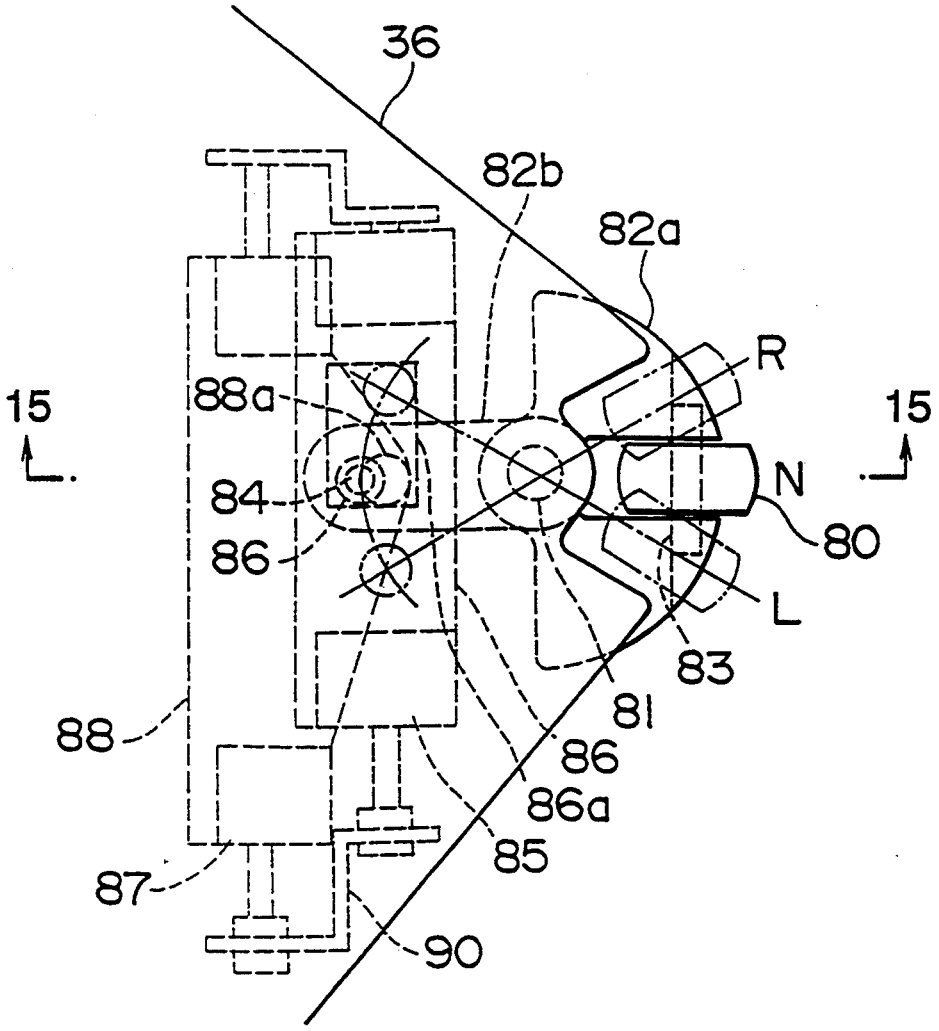
FIG. 14 is a plan view of an oblique roller installation portion in accordance with another embodiment of the present invention.
Figure 15:
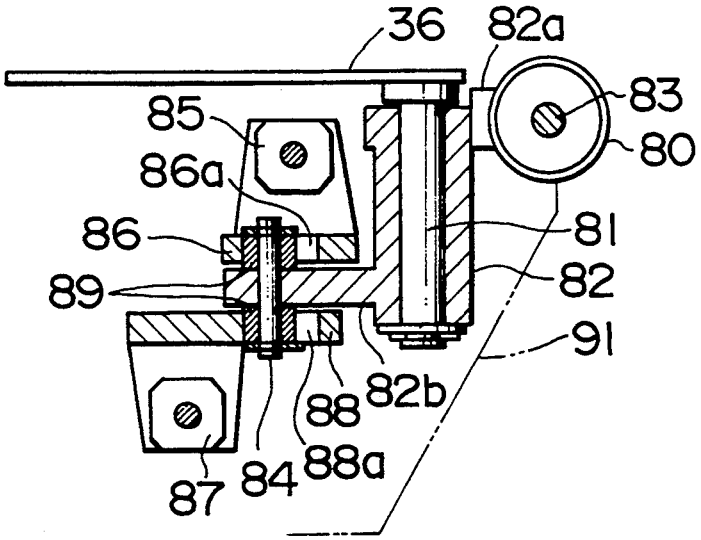
FIG. 15 is a sectional view taken along the line 15—15 of FIG. 14.

Next, an oblique roller of another embodiment of the present invention, which is installed at the convex front edge, will be described with reference to FIGS. 14 and 15. FIG. 14 is a plan view of an oblique roller installation portion, and FIG. 15 is a sectional view taken along the line 15—15 of FIG. 14. In these figures, reference numeral 80 denotes an oblique roller. The oblique roller 80 is rotatably mounted to a roller bracket 82 with a horizontal pin 83. The roller bracket 82 is pivotally mounted to a vertical shaft 81 fixed to the convex front edge 36. The peripheral part of the oblique roller 80 protrudes from the roller bracket 82 so as to touch the sheet 15 passing there. The part 82*a* of the roller bracket 82, which supports the oblique roller 80, fills the notch at the circular part at the tip of the convex front edge 36 with a semicircular plate. At the lower part of the roller bracket 82, an arm part 82*b* is formed. At the tip of the arm part 82*b*, a pin 84 is fitted. Reference numerals 85, 86, and 87, 88 denote an air cylinder and a drive plate fixed to the air cylinder, respectively. The drive plate 86 has a square hole 86*a*, and the drive plate 88 has an elongated hole 88*a*. These holes engage with the aforementioned pin 84 via rollers 89. The oblique roller 80 can take the neutral position N in the tractive direction, the position L rotating approximately 30 degrees to the left (lower side in the figure), and the position R rotating approximately 30 degrees to the right by means of the drive plates 86 and 88. Reference numeral 90 denotes a bracket for fixing the rods of the air cylinders 85 and 87 to the convex front edge 36, and 91 denotes a cover for covering the mechanism.

Photoelectric side edge detecting sensors 92, which are indicated by the two-dot chain line in FIG. 2, are installed above the vicinity of the sheet introducing portion of the mounting stand (above the frame 38 in the figure). Two sensors 92 are installed at both sides of the correct position where the aligning side edge $Y_b$ of the sheet 15 is drawn.

The position where the side edge $Y_b$ of the sheet 15 passes the convex front edge 36 sometimes deviates from the correct position. In this case, the lateral resistance force applied by the convex front edge 36 increases, so that the sheet 15 cannot be pulled back to the correct position only by the tension of the clip 17 on the side edge $Y_b$ in some cases. At this time, the oblique roller 80 functions in such a manner as described below.

Figure 16:
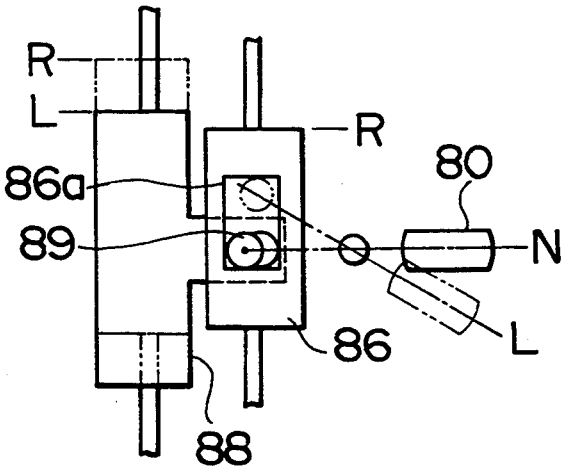
FIG. 16 is a view for illustrating the operation of the oblique roller shown in FIG. 14.
Figure 17:
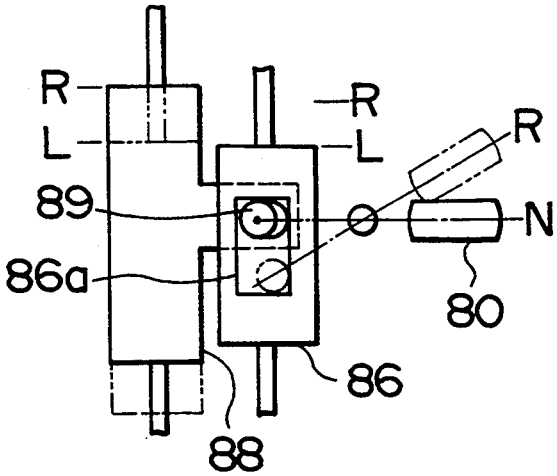
FIG. 17 is a view for illustrating the operation of the oblique roller shown in FIG. 14.

First, the operation of the oblique roller 80 will be described with reference to FIGS. 16 and 17. The drive plate 86 of the air cylinder 85 can take position R shown in FIG. 16 and position L shown in FIG. 17. The drive plate 88 of the air cylinder 87 can take position L where the roller 89 abuts against the left side (lower side in the figure) of the square hole 86*a* and position R where the roller 89 abuts against the right side (upper side in the figure) of the square hole 86*a*, as shown in FIGS. 16 and 17. When the drive plate 86 lies at position R shown in FIG. 16 and the drive plate 88 lies at position L, the oblique roller 80 lies at the neutral position N (indicated by the solid line in FIG. 16). When the drive plate 88 moves to position R, the oblique roller 80 rotates clockwise (to the lower side in the figure), moving to the left position L (indicated by the two-dot chain line in FIG. 16). When the drive plate 86 lies at position L shown in FIG. 17 and the drive plate 88 lies at position R, the oblique roller 80 lies at the neutral position N (indicated by the solid line In FIG. 17). When the drive plate 88 moves to position L, the oblique roller 80 rotates counterclockwise, moving to the right position R (indicated by the two-dot chain line in FIG. 17). The requirement is that the oblique roller can take positions N, L, and R. Therefore, the above-described driving mechanism may consist of two rotary cylinders or a single cylinder which is servo-controlled.

When the tip of the sheet 15 advances onto the mounting stand 35, the side edge detecting sensor 92 transmits the detected condition to the controller 50. The controller 50 determines at which position the side edge $Y_b$ of the sheet 15 lies: in the correct position range (one sensor is ON and the other sensor is OFF), at a position deviating to the left (two sensors are OFF), or at a position deviating to the right (two sensors are ON). If the side edge $Y_b$ of the sheet 15 deviates to the right or the left, the cylinders 85 and 87 are operated to change the direction of the oblique roller 80, so that the cloth side edge $Y_b$ is guided to the correct position range. The oblique roller 80 does not give the sheet 15 a resistance force in the rotating direction, but gives a great resistance force at right angles to the rotating direction. Therefore, the sheet 15 moves in the rotating direction of the oblique roller 80. Thus, the sheet 15 moves laterally at a speed almost one half the speed in the tractive direction, the trajectory being corrected. If the side edge $Y_b$ is in the correct position range, the oblique roller 80 need not be used, so that the oblique roller can remain at the neutral position.

Figure 18:
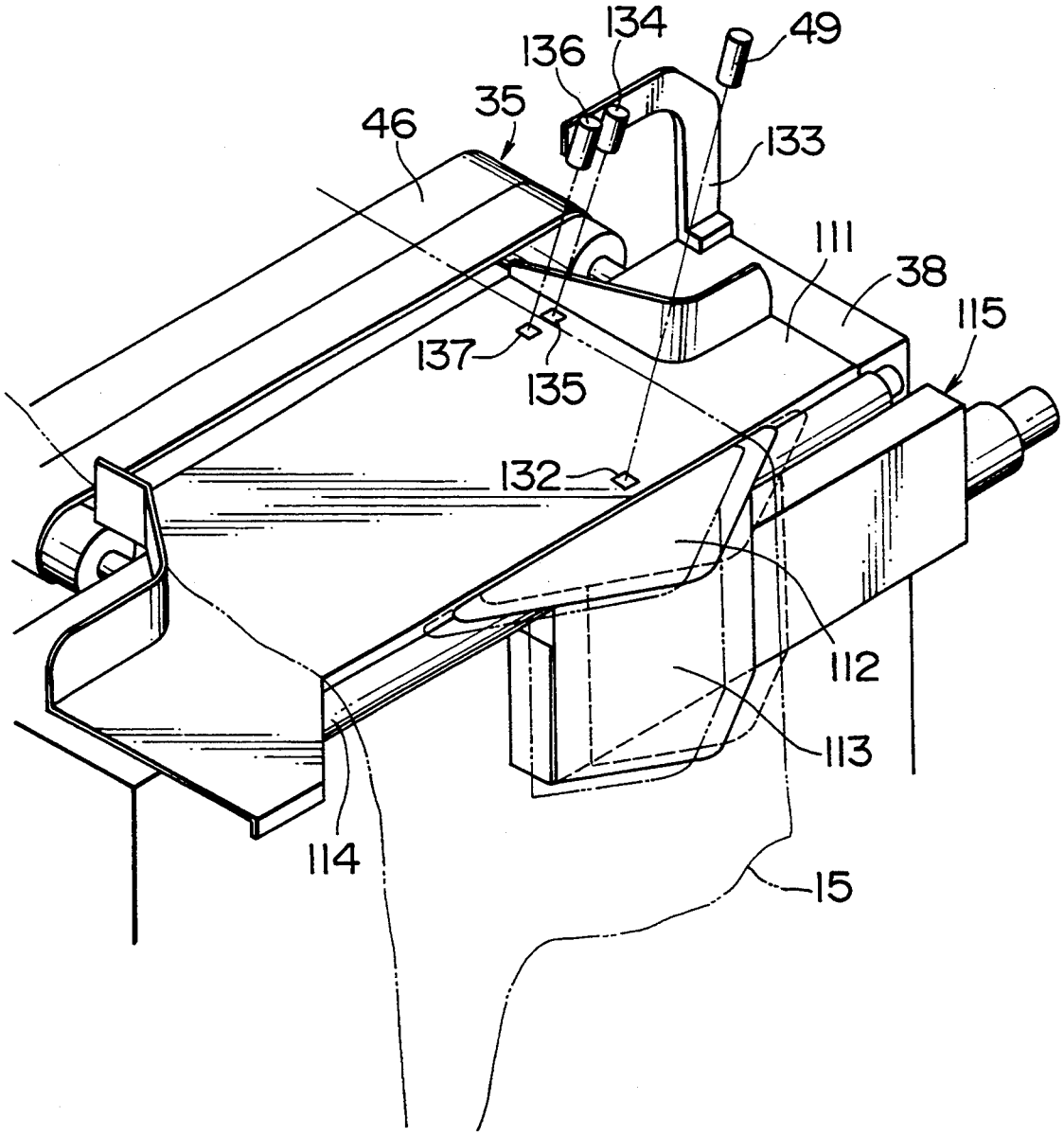
FIG. 18 is a perspective view of a spread plate and cloth side edge sensors in accordance with another embodiment of the present invention.
Figure 19:
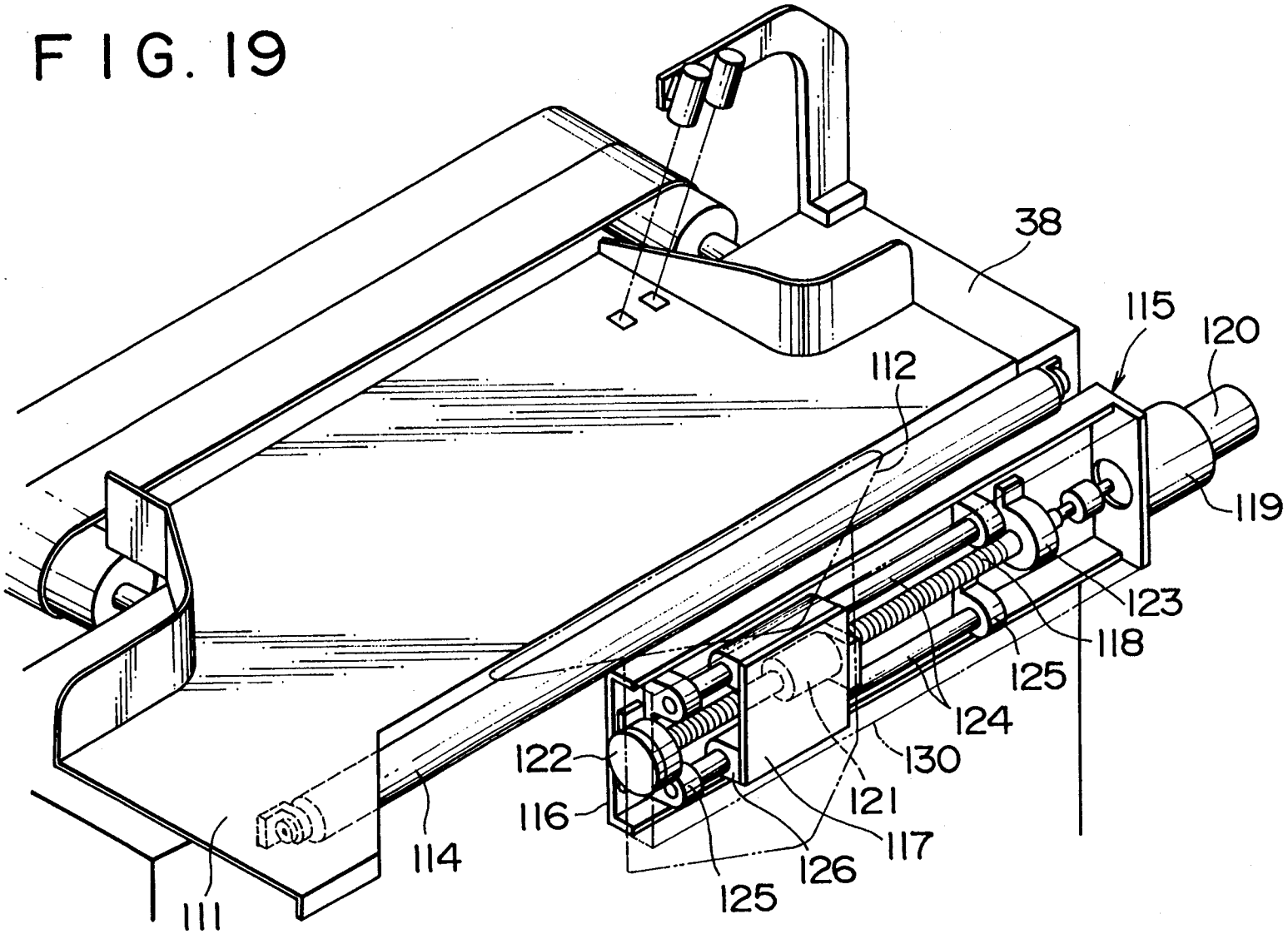
FIG. 19 is a perspective view of a driving unit for operating the spread plate in accordance with another embodiment of the present invention.

FIGS. 18 and 19 show a convex front edge which can slide at right angles to properly draw the side edge of a deformed sheet onto the mounting stand and a sheet side edge detecting sensor means for issuing a command to a driving means of the convex front edge. In the figures, a spread plate 112 (having the same sheet drawing function as that of the convex front edge), which can slide at right angles to the sheet tractive direction, is installed in place of the aforementioned fixed convex front edge 36 as shown in FIG. 1. The spread plate 112, together with a spread plate support box 113, forming a housing, is horizontally driven along the sheet guide plate 111 by means of a horizontal driving unit 115 fixed to the frame 38. Reference numeral 114 denotes a guide roller for the sheet 15. The reflection plate 132 placed on the sheet guide plate 111 receives the light source beam of the sensor 49 for detecting the passage of the aforementioned gripping device 16 and the passage of the end edge $Y_c$ of the sheet 15, and returns the reflected light to the sensor 49. A sensor mount 133 is fixed to the frame 38. The sensors 134 and 136 for detecting the side edge position of the sheet 15 are installed on the sensor mount 133. The sensors 134 and 136, like the sensor 49, are photoelectric sensors which are provided with a light source as a unit. The reflection plate 135 placed on the sheet guide plate 111 corresponds to the sensor 134, whereas the reflection plate 137 corresponds to the sensor 136. The reflection plates 135 and 137 are located at both sides at an equal distance from the correct pull-in line of the side edge of the sheet 15 being drawn.

FIG. 19 is a perspective view showing the construction of a horizontal driving unit 115. Reference numeral 116 denotes a driving unit frame. A ball screw 118 is rotatably supported by bearings 122 and 123 installed to the unit frame 116. The shaft end of the ball screw 118 is directly connected to the output shaft of a servomotor 119 with brake, which is installed on the end face of the unit frame 116. The servomotor 119 with brake is provided with a rotation detector 120. A ball screw nut 121 engaging with the ball screw 118 is installed on a moving base 117. Two guide bars 124 are fixed to the unit frame 116 in parallel to the ball screw 118 via four brackets 125. A pair of linear ball bearings 126, which fit to the guide bar 124 and can slide in the axial direction, are also installed to the moving base 117. When the servomotor 119 rotates and thereby the ball screw 118 is turned, the moving base 117 moves horizontally by being guided by the guide bars 124, so that the spread plate 112 and the spread plate support box 113, which are installed to the moving base 117, move horizontally while keeping their posture.

Figure 20:
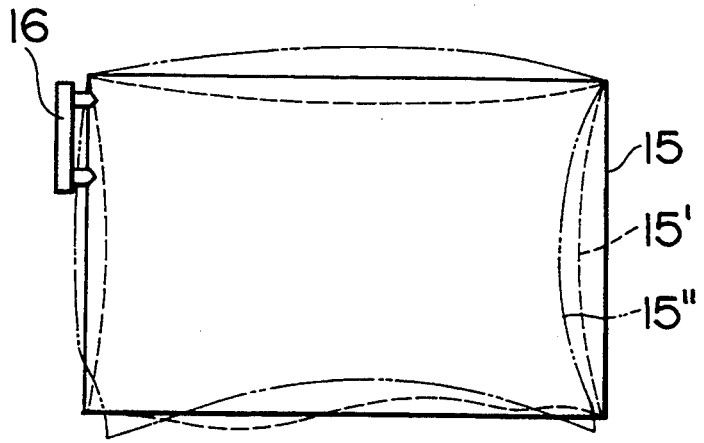
FIG. 20 is an expanded view of deformed cloths handled by the apparatus for spreading a rectangular cloth.
Figure 21:
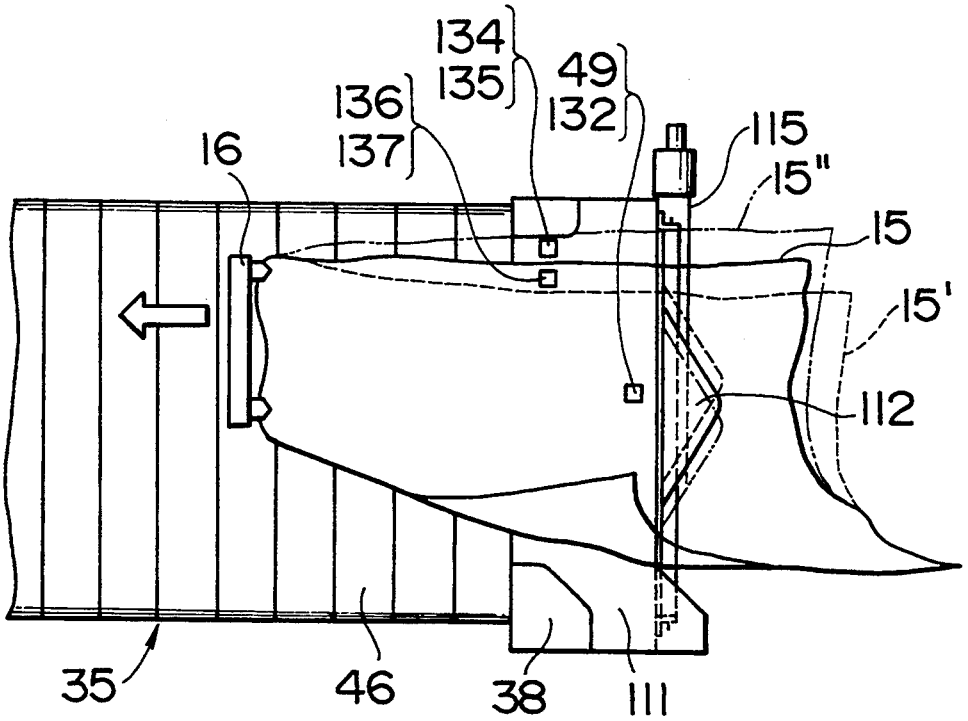
FIG. 21 is a plan view of a mounting stand, a spread plate, and cloth side edge sensors in accordance with another embodiment of the present invention.

The operation of the slidable convex front edge constructed as described above and the sheet side edge detecting sensor means which issues command to the driving means of the convex front edge will be described. FIG. 20 shows two deformed shapes of the sheet 15: the deformed sheet 15′ (indicated by the broken line) and the deformed sheet 15″ (indicated by the two-dot chain line). FIG. 21 shows a condition where these sheets are drawn onto the mounting stand 35 by the gripping device 16.

When the gripping device 16 and the sheet 15 gripped by the gripping device 16 pass over the reflection plate 132 and intercept the light source beam of the sensor 49, the signal from the sensor 49 activates the not illustrated control circuit, so that the sensor function of the photoelectric sensors 134 and 136, which has been in an ON state, is turned on, and the presence/absence of the sheet 15 passing over the reflection plates 135 and 137 is detected by the sensors 134 and 136. The detection result is transmitted as an electrical signal.

When the normal sheet 15 passes through, and the side edge of the sheet 15 passes through the position between the reflection plates 135 and 137 (the photoelectric sensor 134 is ON, and the photoelectric sensor 136 is OFF), the control circuit judges that the condition is normal, so that the spread plate 112 is not operated. If the deformed sheet 15′ passes through, both the sensors 134 and 136 turn on, and send a signal indicative of the absence of sheet to the control circuit. The control circuit processes the signal and sends it to the servomotor 119. The servomotor 119 rotates to move the spread plate 112 in the upward direction in the figure (the direction of the position indicated by the broken line), so that the sheet 15′ is moved to the correct position in the upward direction. When the side edge of the sheet 15′ is moved to the middle position between the reflection plates 135 and 137, the sensor 136 is turned off and sends a signal indicative of the presence of sheet to the control circuit, so that the movement of the spread plate 112 is stopped. If the deformed sheet 15″ passes through, both the sensors 134 and 136 turn off, and send a signal indicative of the absence of sheet to the control circuit. The control circuit processes the signal and sends it to the motor 119. The motor 119 rotates in the direction reverse to that of the aforementioned case to move the spread plate 112 in the downward direction in the figure (the direction of the position indicated by the two-dot chain line), so that the sheet 15″ is moved to the correct position. When the side edge of the sheet 15″ is moved to the middle position between the reflection plates 135 and 137, the sensor 134 is turned on, and sends a signal indicative of the absence of sheet to the control circuit, so that the movement of the spread plate 112 is stopped. When the sheet 15 passes through and the reflection plate appears again, so that the sensor 49 sends a signal indicative of the absence of sheet, the function of the side edge sensors 134 and 136 is turned off. At the same time, the motor 119 rotates the number of turns detected last by the rotation detector 120 in the reverse direction. Therefore, the spread plate 112 returns to the neutral position.

Figure 22:
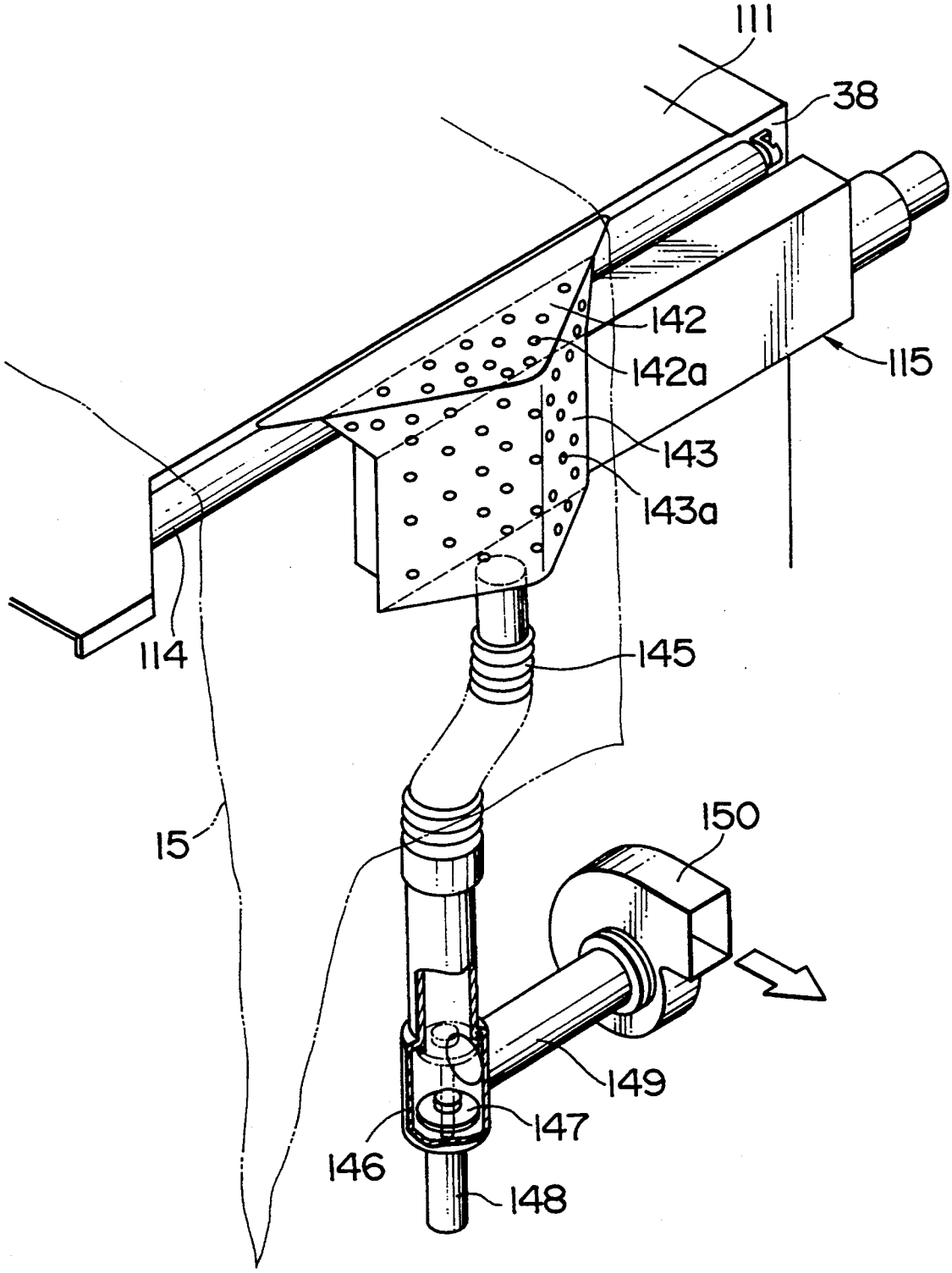
FIG. 22 is a perspective view of a spread plate with suction holes in accordance with another embodiment of the present invention.

FIG. 22 shows a spread plate 142 and a spread plate support box 143, which have many suction holes and compose a housing as a unit, installed in place of the spread plate 112 and the spread plate support box 113, which have no suction holes, described with reference to FIG. 18. This spread plate 142 is, like the aforementioned spread plate, installed to the horizontal driving unit 115, and has a function of aligning the side edge of the sheet 15 with the specified line on the basis of the sheet detection signal generated by the sheet side edge sensors 134 and 136. A flexible pipe 145 is installed under the spread plate support box 143, and a suction blower 150 is connected to the distal end of the flexible pipe 145.

When the sheet 15 is dry and light in weight, the tension resistance due to the spread plate 112 is low. Therefore, it is sometimes difficult to perform direction control of the side edge of the sheet 15 because the sheet 15 slips laterally on the spread plate 112. In this case, if the suction blower 150 is rotated, the blower 150 sucks air from the housing composed of the spread plate 142 and the spread plate support box 143, so that the sheet 15 is attracted by suction holes 142*a* and 143*a*, by which the tension resistance of the sheet 15 is increased. Thus, the direction control by the lateral movement of the side edge of the sheet 15 can be reliably performed.

Further, FIG. 22 shows an example in which an air valve 147, which is operated by a pneumatic cylinder 148, is installed between the flexible pipe 145 and a suction mouth pipe 149 of the blower 150. The air valve 147 is controlled so as to open the suction pipe line during the time when the sheet 15 is drawn (that is, during the time when the light beam generated by the sensor 49 is intercepted by the sheet 15). The air valve 147 is operated in a very short time by the pneumatic cylinder 148, and can momentarily open/close the suction pipe line of the suction blower 150 which remains rotating. When the sheet 15 is not at the pull-in position, the air valve 147 closes the suction pipe line to prevent an unwanted sheet 15 present nearby from being attracted.

A obliquely located guide roller mechanism, which is another system for correcting the sheet pull-in line when a deformed sheet is handled, and the control thereof will be described with reference to FIGS. 23 to 26.

Figure 23:
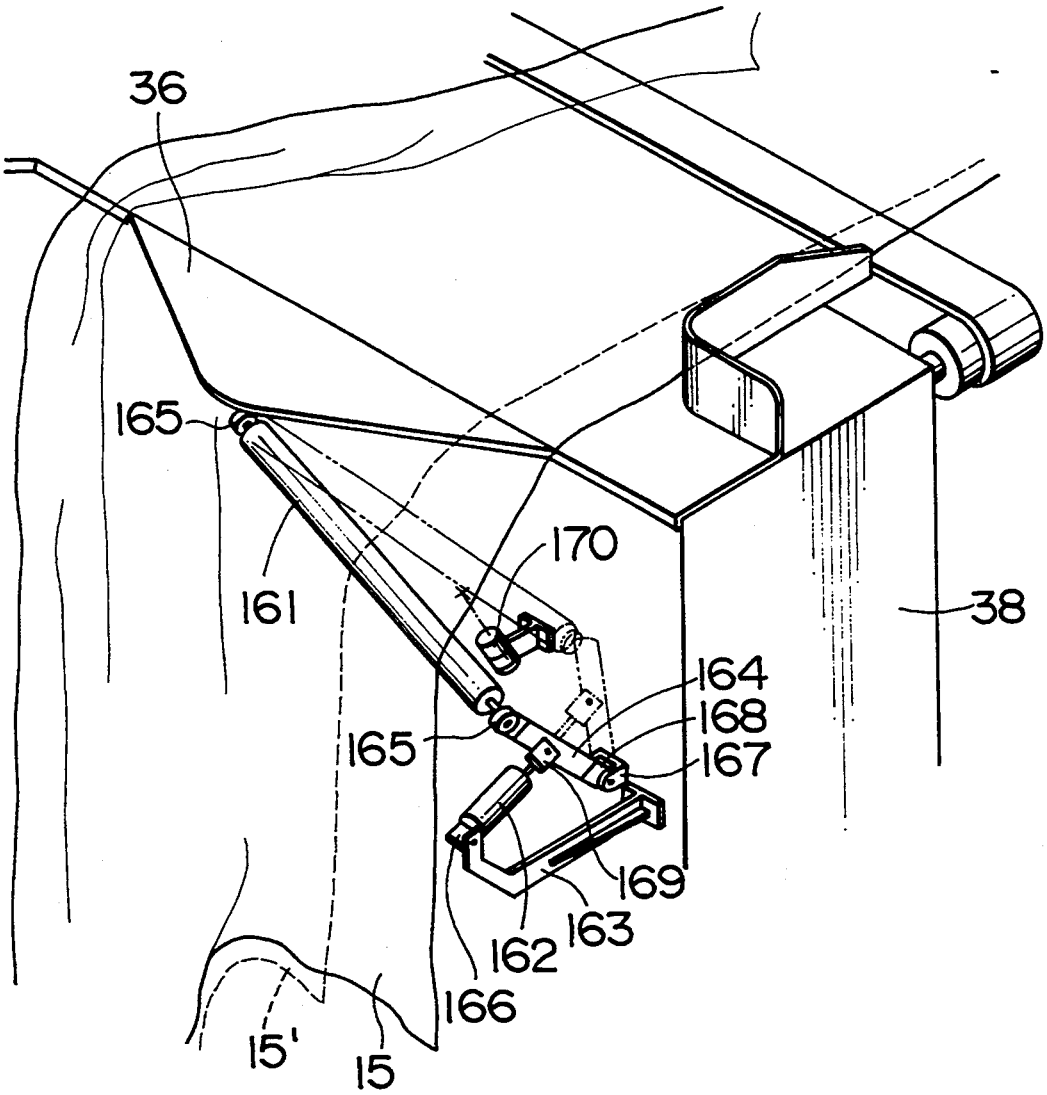
FIG. 23 is a perspective view of a cloth side edge pull-in line correcting mechanism in accordance with another embodiment of the present invention.
Figure 24:
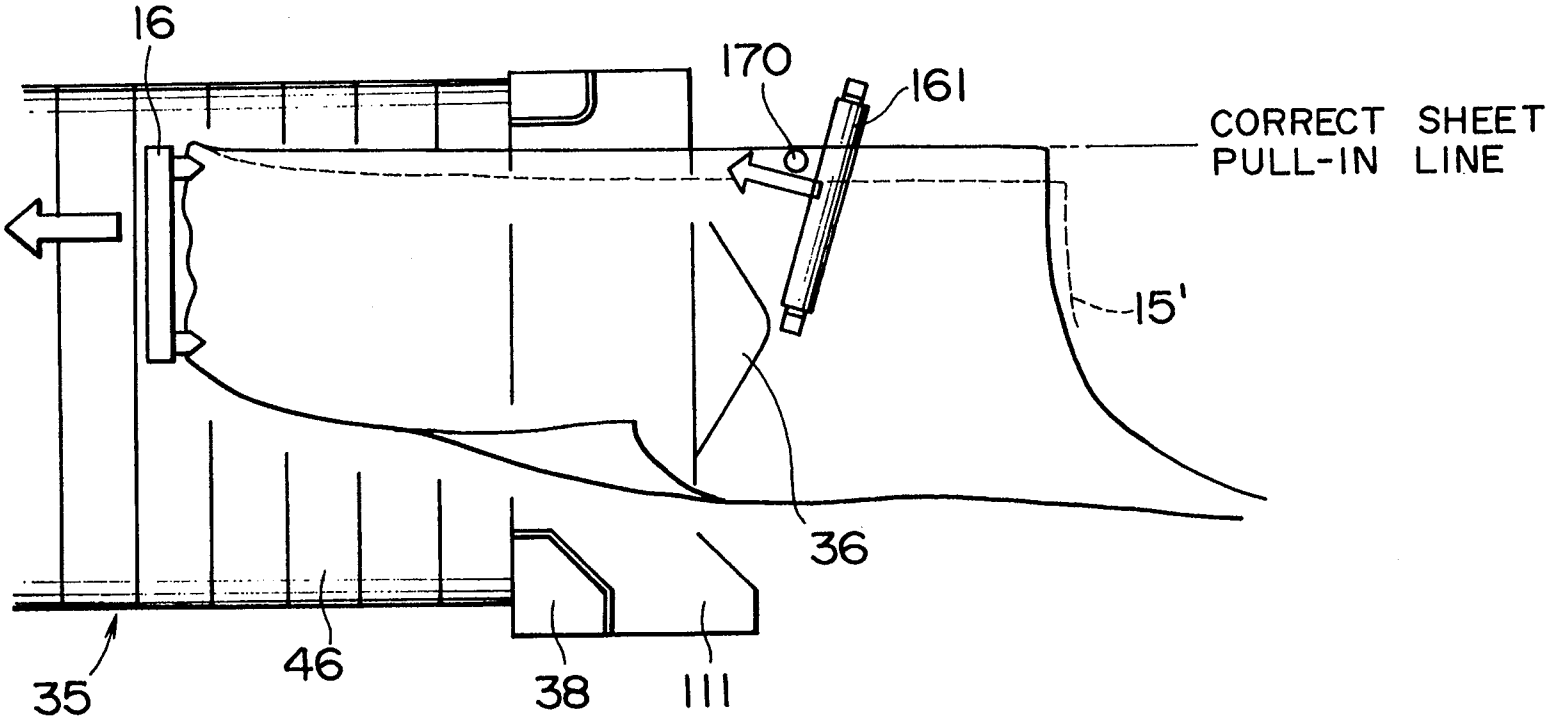
FIG. 24 is an expanded plan view of a cloth side edge pull-in line correcting mechanism in accordance with another embodiment of the present invention.

FIGS. 23 and 24 show an example of a mechanism for correcting the sheet pull-in line only when the sheet 15 deviates inside and obliquely from the correct sheet pull-in line. FIG. 23 is a perspective view of the mechanism, and FIG. 24 is an expanded view along the flow of the sheet 15. The deformed sheet is indicated by 15′ as in the aforementioned embodiment.

Under the oblique edge of the convex front edge 36 of the mounting stand 35, a freely rotating guide roller 161, which crosses the oblique edge line in the vicinity of the vertex of the convex form and has its axis on an obliquely inclined straight line, is supported by the convex front edge 36 and an operating lever 164 via a spherical bearing 165. The operating lever 164 is supported by the shaft of a lever support 167, which is fixed to the frame 38, via a spherical bearing 168. The lever support 167 is connected to the operating rod of a pneumatic actuator 162 with a pin joint 169. The pneumatic actuator 162 is installed to an actuator support 163, which is fixed to the frame 38, via a spherical bearing 166. A photoelectric sensor 170 detects the edge of the sheet 15 passing through the correct pull-in line. The sheet edge detection signal generated by the sensor 170 is sent to the not illustrated control circuit. The control circuit judges the condition, and controls the pneumatic actuator 162.

Next, the operation of the mechanism for correcting the sheet pull-in line by means of the guide roller 161. The guide roller 161 which is located at the position indicated by the solid line in FIGS. 23 and 24 has a function of moving the sheet 15 in the outside direction from the pull-in line by being rotated by a frictional force due to the weight of the hung sheet 15 when the sheet 15 passes through the guide roller 161 and the convex front edge 36. When the deformed sheet 15' (indicated by the broken line in FIG. 23) is drawn, the side edge of the sheet 15' is guided to the outside by this guide roller 161. When the side edge of the sheet 15' reaches the correct sheet pull-in line, the photoelectric sensor 170 detects the sheet 15, and sends a signal to the control circuit. Then, the pneumatic actuator 162 is operated by the command issued by the control circuit, so that the guide roller 161 is pushed into the position indicated by the two-dot chain line, by which the function of guiding the sheet 15 is eliminated.

The mechanism and the control of an embodiment which uses the guide roller 161 and can correct the sheet pull-in line even if the deformed sheet 15' deviates obliquely to the inside and outside from the correct sheet pull-in line will be described with reference to FIGS. 25 and 26.

Figure 25:
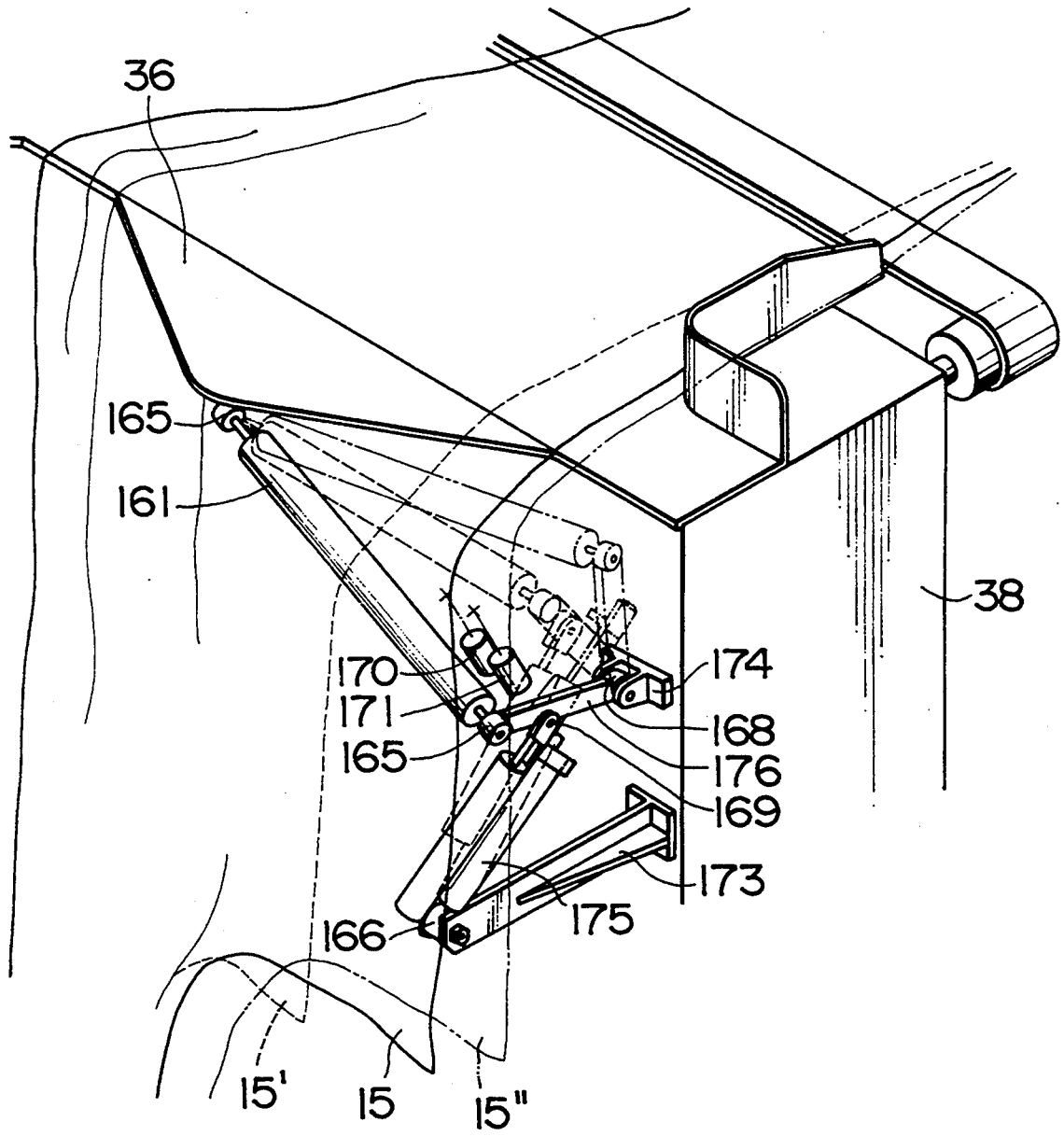
FIG. 25 is a perspective view of a second example of a cloth side edge pull-in line correcting mechanism in accordance with another embodiment of the present invention.
Figure 26:
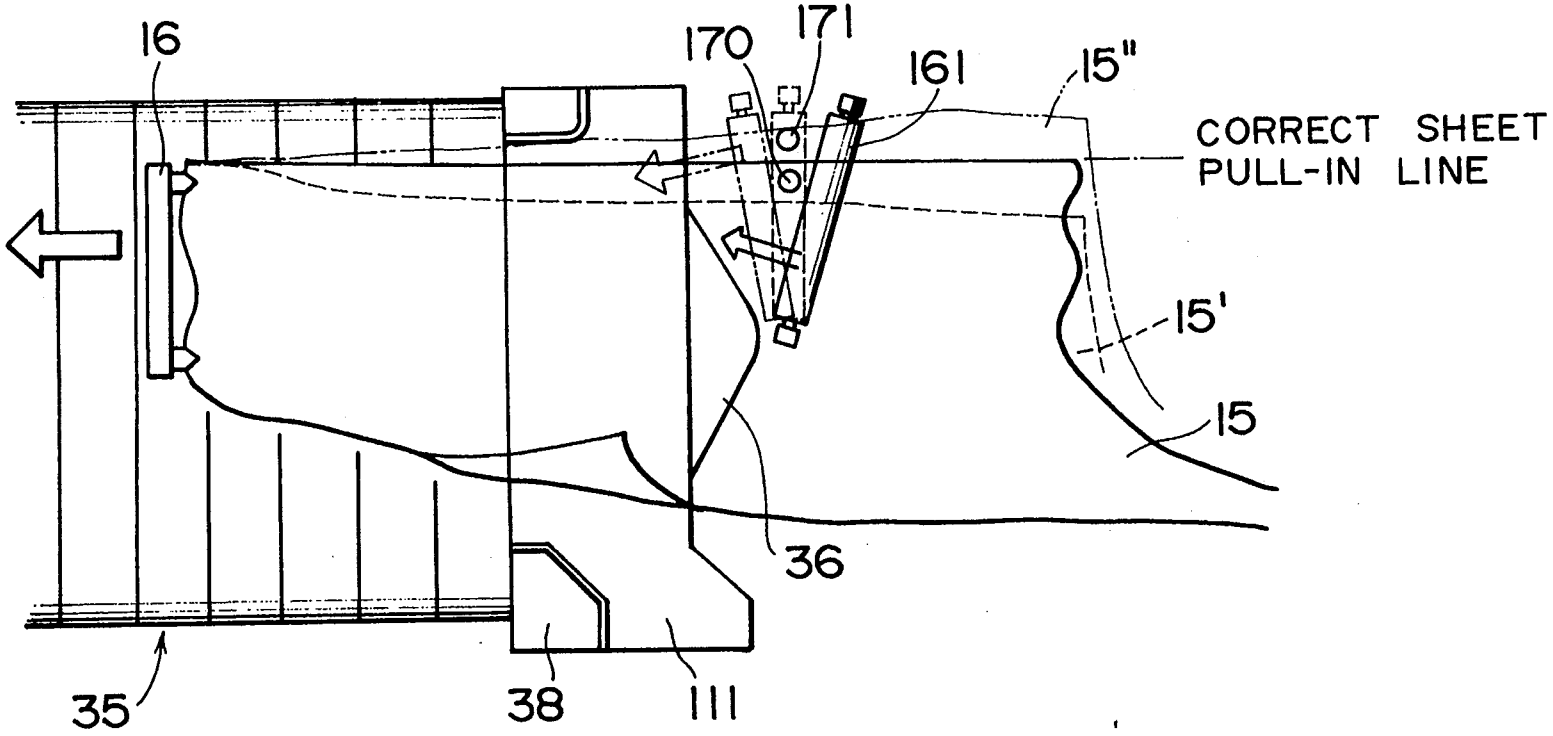
FIG. 26 is an expanded plan view of a second example of a cloth side edge pull-in line correcting mechanism in accordance with another embodiment of the present invention.

FIG. 25 is a perspective view of the mechanism, and FIG. 26 is an expanded view along the flow of the sheet 15. The deformed sheet is denoted by symbols 15' and 15" as in the aforementioned embodiment. Under the oblique edge of the convex front edge 36 of the mounting stand 35, the freely rotating guide roller 161, which crosses the oblique edge line in the vicinity of the vertex of the convex form and has its axis on an obliquely inclined straight line, is supported by the convex front edge 36 and an operating lever 176 via the spherical bearing 165. The operating lever 176 is supported by the shaft of a lever support 174, which is fixed to the frame 38, via the spherical bearing 168. The lever support 174 is connected to the operating rod of a two-stage pneumatic actuator 175 with the pin joint 169. The two-stage pneumatic actuator 175 is installed to an actuator support 173, which is fixed to the frame 38, via the spherical bearing 166. Photoelectric sensors 170 and 171 detect the edge of the sheet lying within the allowable range along the correct pull-in line. The sheet edge detection signal generated by the sensors 170 and 171 is sent to the not illustrated control circuit. The control circuit judges the condition, and controls the two-stage pneumatic actuator 175.

When the operating rod of the two-stage pneumatic actuator 175 retracts into the cylinder, the operating lever 176 and the guide roller 161 are located at the position indicated by the solid line in FIG. 25. When the drawn sheet 15 is fed while being in contact with the guide roller 161 located at this position, the sheet 15 is moved in the direction indicated by the arrow of solid line in FIG. 26, the sheet 15 being shifted to the outside. When the first-stage operating rod of the two-stage pneumatic actuator 175 protrudes, the guide roller 161 stops at the position indicated by the broken line in the figures, that is, the position at right angles to the sheet pull-in line. In this case, the sheet does not move in either direction. When the first- and second-stage operating rods of the two-stage pneumatic actuator 175 protrude, the operating lever 176 and the guide roller 161 move to the position indicated by the two-dot chain line in FIG. 25. When the drawn sheet 15 is fed while being in contact with the guide roller 161 located at this position, the sheet 15 is moved in the direction indicated by the arrow of the two-dot chain line in FIG. 26, the sheet 15 being shifted to the inside.

Next, the operation of the mechanism for correcting the sheet pull-in line by using the second guide roller 161 is described.

When the deformed sheet 15' (the sheet having the side edge located obliquely to the inside, indicated by the broken line in FIG. 25) passes through the convex front edge 36, the sensors 170 and 171 do not detect the sheet 15'. This indicates that the edge of the sheet 15' deviates from the correct pull-in line to the inside. This detection signal is sent to the control circuit, and the two-stage pneumatic actuator 175 is operated by the command issued by the control circuit so that the first- and second-stage operating rods are retracted. Therefore, the guide roller 161 is moved to the operating position indicated by the solid line to perform the function of drawing the sheet 15' to the correct pull-in line. When the sheet 15' moves to the outside, the sensor 170 generates a signal indicative of the presence of sheet, and the sensor 171 sends a signal indicative of the absence of sheet to the control circuit, and then the control circuit judges that the edge of the passing sheet 15' has drawn to the correct pull-in line, so that the first-stage operating rod of the two-stage pneumatic actuator 175 is operated, by which the guide roller 161 is controlled so as to move to the neutral position and stop at this position.

When the deformed sheet 15" (the sheet having the side edge located obliquely to the outside, indicated by the two-dot chain line in FIG. 25) passes through the convex front edge 36, both the sensors 170 and 171 detect the sheet 15". This indicates that the edge of the sheet 15" deviates from the correct pull-in line to the outside, This detection signal is sent to the control circuit, and the two-stage pneumatic actuator 175 is operated by the command issued by the control circuit so that the first- and second-stage operating rods are extended. Therefore, the guide roller 161 is moved to the operating position indicated by the two-dot chain line to perform the function of drawing the sheet 15" to the correct pull-in line. When the sheet 15" moves to the inside, the sensor 171 detects the absence of a sheet, and the sensor 170 sends a signal indicative of a the presence of sheet to the control circuit, and then the control circuit judges that the edge of the passing sheet 15" has drawn to the correct pull-in line, so that the first-stage operating rod of the two-stage pneumatic actuator 175 is reversely operated and returned, by which the guide roller 161 is controlled so as to move to the neutral position and stop at this position.

A sensor for detecting the sheet 15 drawn onto the mounting stand 35 is provided. The electric circuit is built so that the sensor 170 is turned on by the signal indicative of the presence of sheet which is generated by this sensor. Therefore, the guide roller 161 is always located at the neutral position when the sheet is absent. In the above embodiment, the convex front edge 36 may be constructed so that it can slide at right angles to the sheet tractive direction.

Figure 27:
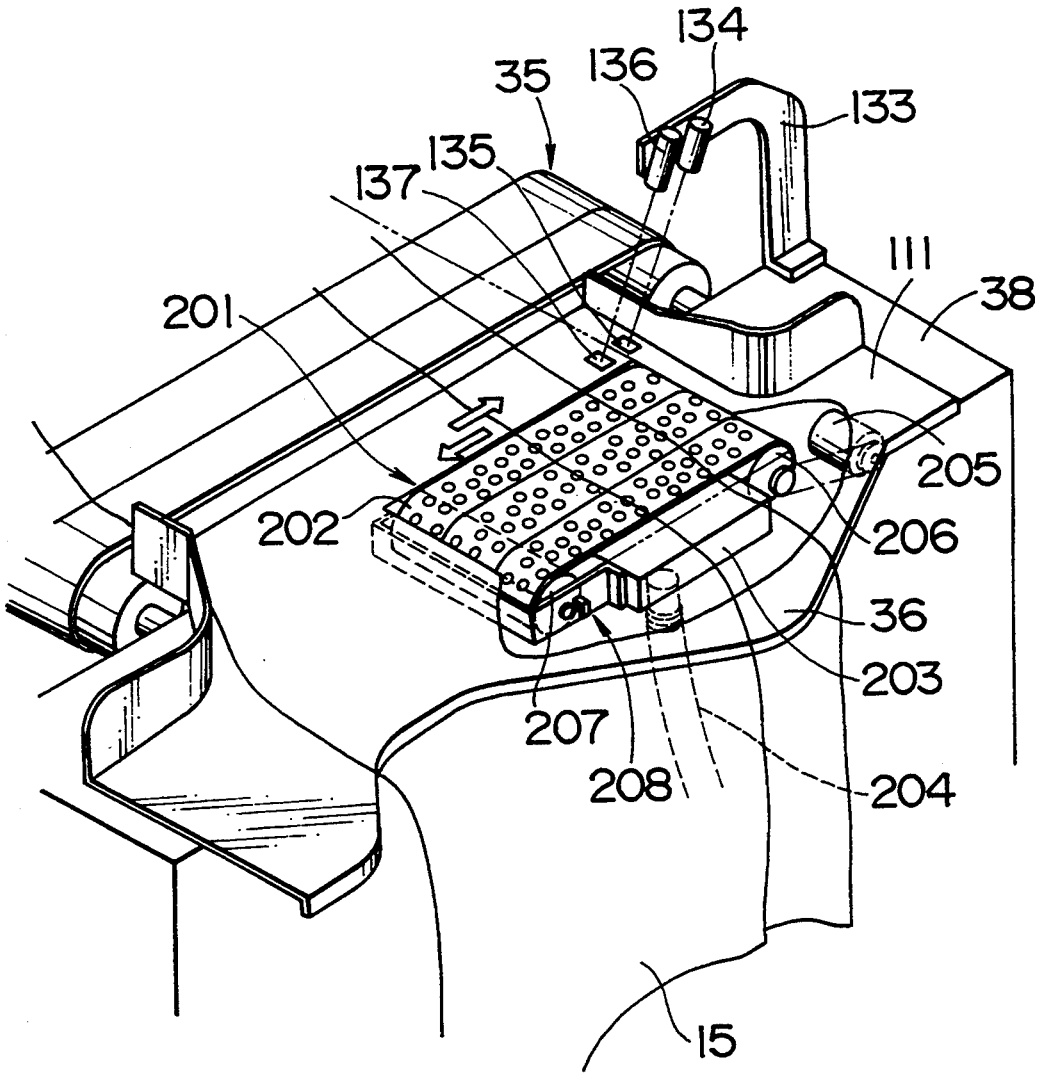
FIG. 27 is a perspective view of a cloth side edge aligning mechanism using a suction conveyor in accordance with another embodiment of the present invention.
Figure 28:
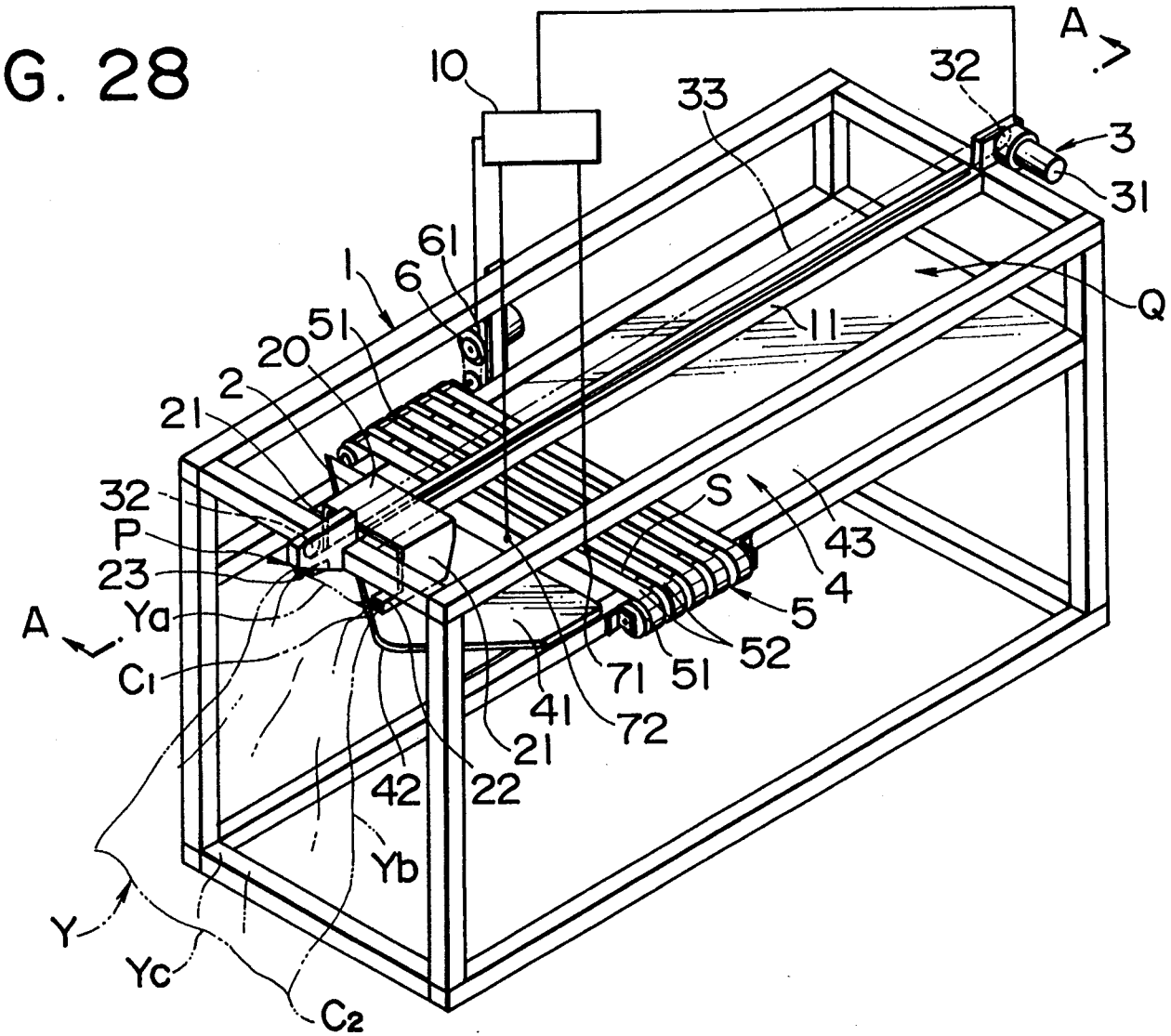
FIG. 28 is a perspective view of a conventional apparatus for spreading a rectangular cloth.
Figure 29:
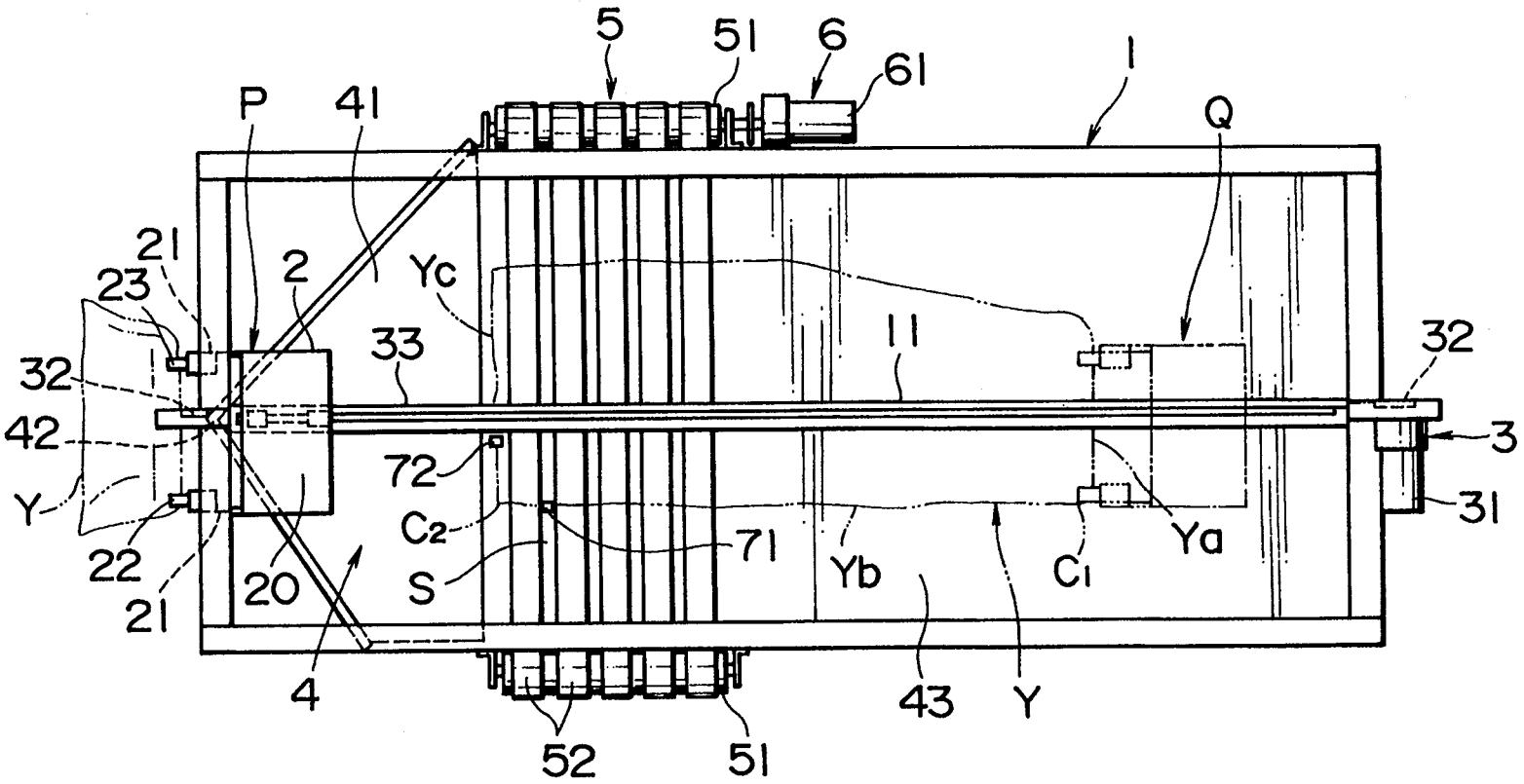
FIG. 29 is a plan view of the apparatus shown in FIG. 28.
Figure 30:
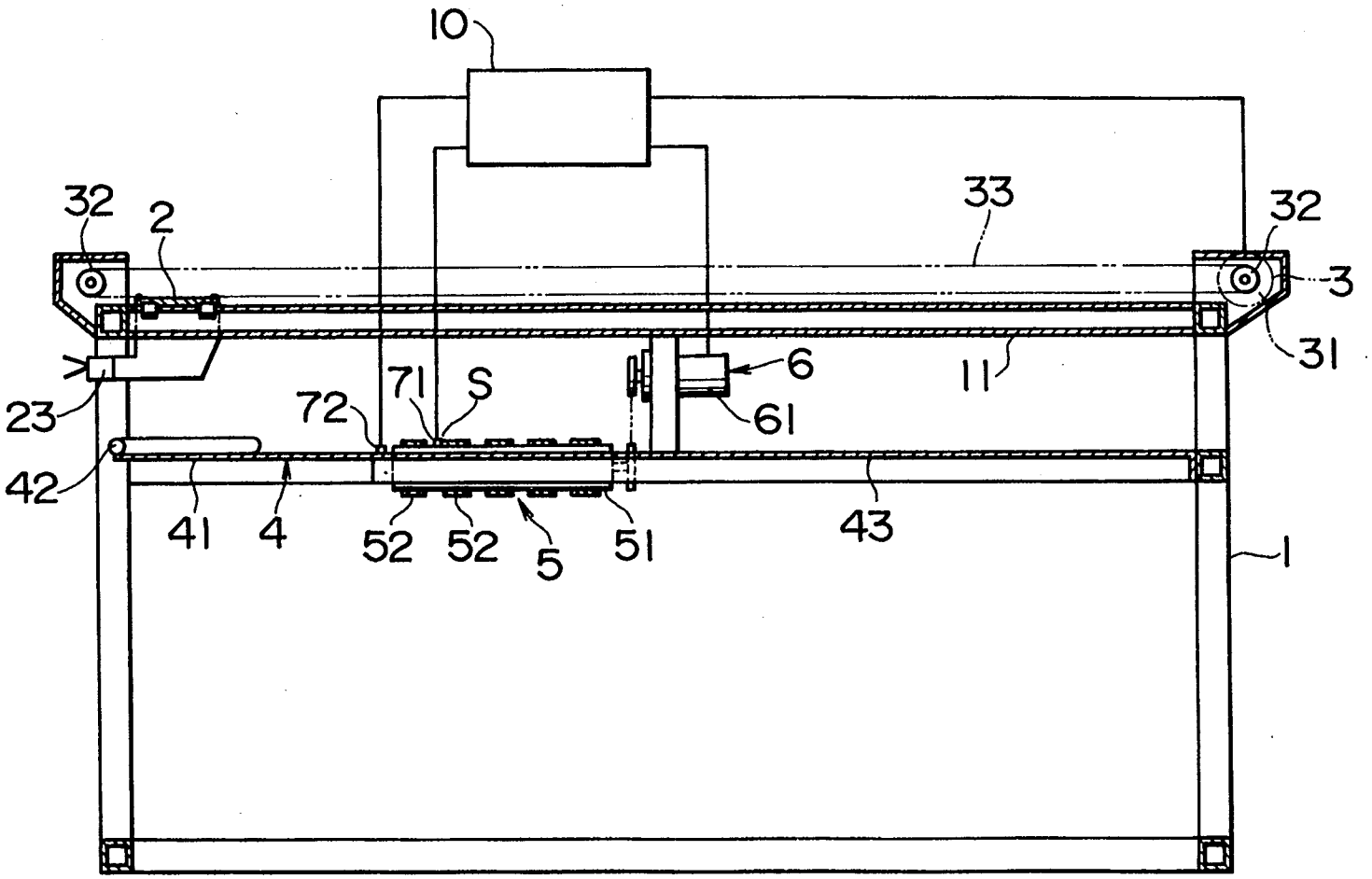
FIG. 30 is a sectional view taken along the line A—A of FIG. 28.
Figure 31:
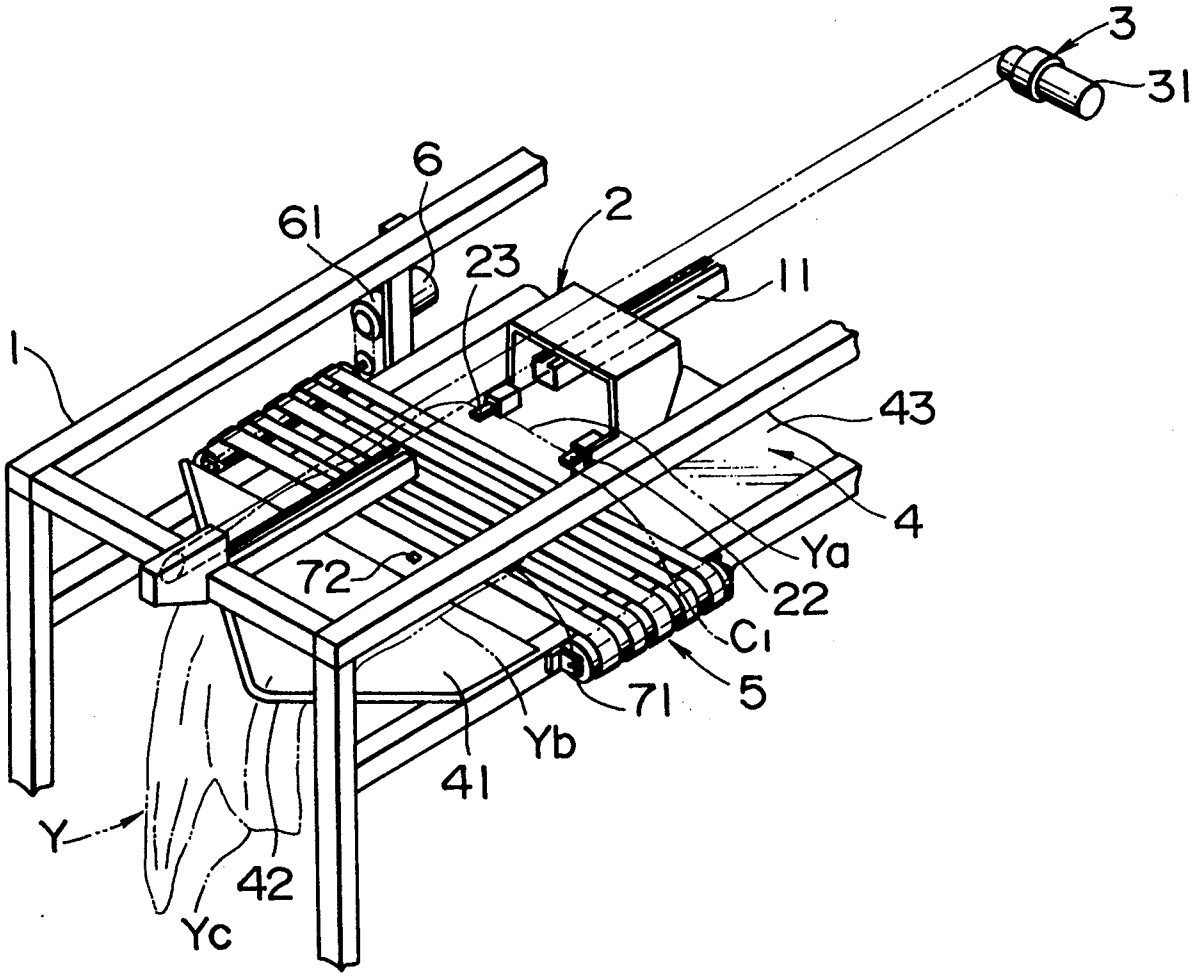
FIG. 31 is a perspective view of the main part of the apparatus shown in FIG. 28.
Figure 32:
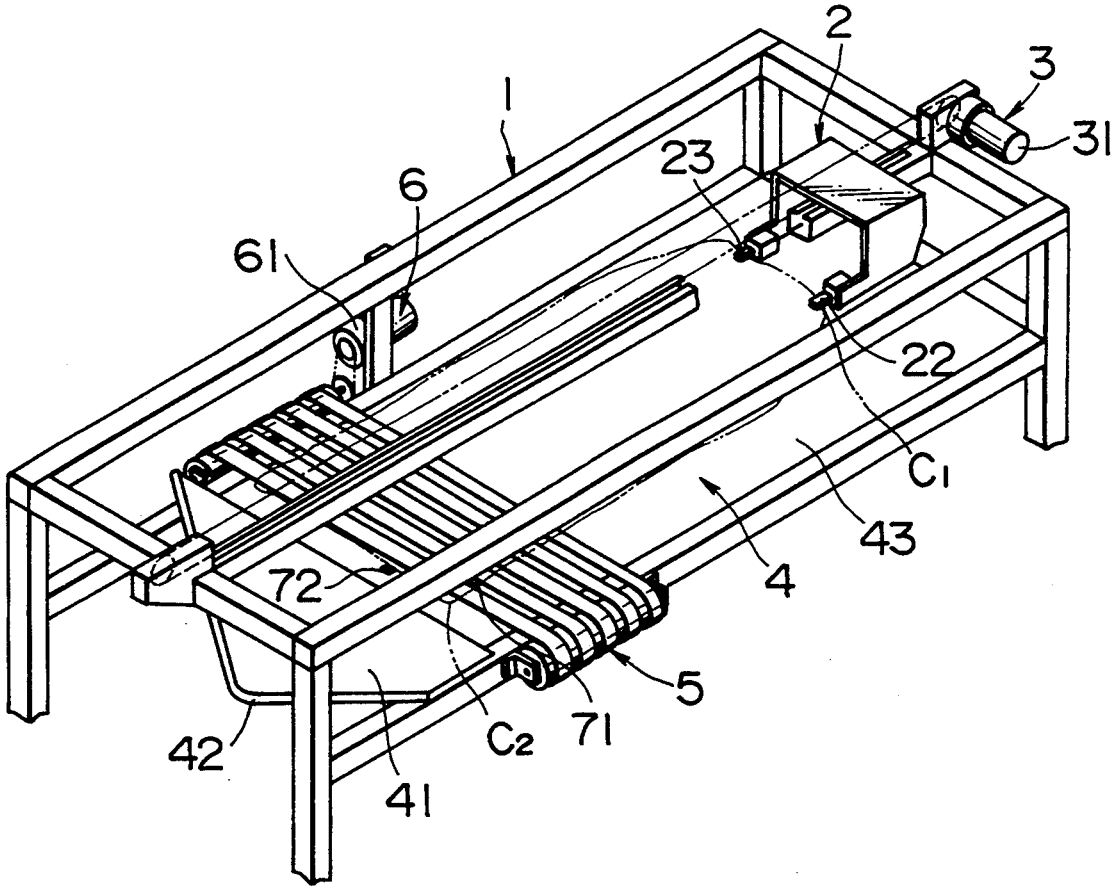
FIG. 32 is a perspective view of the main part of the apparatus shown in FIG. 28, showing a different operating condition.

Finally, another embodiment of a cloth side edge aligning mechanism, which is disposed between the convex front edge of the present invention and the mounting stand and uses a suction belt conveyor driven in both the sheet drawing direction and the direction perpendicular to the sheet drawing direction, will be described with reference to a perspective view of a suction belt conveyor unit 201 shown in FIG. 27.

A suction belt conveyor unit 201 is installed at a position which is at the middle part of the sheet guide 111 disposed between the convex front edge 36, which is the sheet introducing portion, and the mounting stand 35 and is covered by the sheet 15 when the sheet 15 is drawn. The unit 201 is equipped with a suction belt conveyor 202 which is driven in both the sheet drawing direction and the direction perpendicular to the sheet drawing direction and has many suction holes. At the lower part of the suction belt conveyor 202 is installed a suction duct 203 whose upper part is open. The suction duct 203 is connected to a not illustrated suction blower through a flexible pipe 204. The suction belt conveyor 202 is set around pulleys 206 and 207 installed to a frame incorporating with the suction duct 203. Reference numeral 208 denotes a takeup for the shaft of the pulley 207, and 205 denotes a servomotor with brake, which drives the driving-side pulley 206 and can rotate in the normal and reverse directions. The photoelectric sensors 134 and 136, which are also used as a light source, are mounted on the mount 133 installed to the frame 38. These photoelectric sensors 134 and 136, in combination with the reflection plates 135 and 137 installed at both sides of the sheet side edge pull-in line on the sheet guide plate 111, make detection to determine whether the side edge of the sheet 15 lies within the allowable width along the correct sheet pull-in line. The not illustrated control circuit detects the deviation of the sheet side edge based on the signal generated by the photoelectric sensors 134 and 136, and issues a command for the normal or reverse rotation and stopping of the motor 205 with brake to correct the position through which the sheet side edge passes.

Next, the operation of the embodiment of the sheet side edge aligning means using the aforementioned suction belt conveyor unit 201 will be described.

In the process in which the sheet 15 gripped by the gripping device 16 is drawn onto the sheet guide plate 111, the photoelectric sensors 134 and 136 and the reflection plates 135 and 137 installed on the sheet guide plate 111 sense to determine to which side of the inside and the outside the side edge of the sheet 15 being drawn deviates from the allowable width along the correct pull-in line. If both the photoelectric sensors 134 and 136 detect the sheet 15, the sheet 15 deviates to the outside. The detection signal activates the control circuit, so that the sheet 15 is attracted to the suction belt conveyor 202 and moved laterally to the inside so that the sheet side edge aligns with the correct pull-in line. If the sheet side edge comes within the allowable width along the correct pull-in line during this lateral movement, the photoelectric sensor 134 detects the absence of the sheet 15, so that the movement of the suction belt conveyor 202 is stopped by the detection signal. If both the photoelectric sensors 134 and 136 do not detect the sheet 15, the sheet 15 deviates to the inside. The detection signal activates the control circuit, so that the sheet 15 is attracted to the suction belt conveyor 202 and moved laterally to the outside so that the sheet side edge aligns with the correct pull-in line. When the sheet side edge comes within the allowable width along the correct pull-in line, the photoelectric sensor 136 detects the presence of the sheet 15, so that the movement of the suction belt conveyor 202 is stopped by the detection signal.

In addition, this means has a function of smoothing out wrinkles of the portion of the sheet 15 which is not placed on the suction belt conveyor 202.

We claim:

1. An apparatus for spreading rectangular cloth comprising:

a movable gripping device including two clips for gripping the cloth by a corner and an adjacent side edge portion and for hanging the cloth by said corner and said side edge portion;

a mounting stand including a cloth running upper surface for spreading the cloth thereon, a convex front edge for contacting the cloth spread on the stand, wherein the gripped cloth is pulled horizontally on the upper surface of the stand by the gripping device while contacting the convex front edge of the stand;

a belt having a plurality of holes for allowing suction air therethrough on at least half a width thereof;

a suction duct including a plurality of holes positioned below a portion of said belt;

a belt moving/stopping unit, arranged on said mounting stand, including a unit base on a fixed member above said mounting stand, an operating lever rotating around the fixed shaft of said unit base, a brake roller which is mounted to said operating lever for engaging said belt to stop said belt, an air actuator for operating said operating lever, and a sensor for detecting the side edge of the cloth drawn at right angles to the conveyor running direction and generating a cloth detection signal; and a control circuit which issues a command to said air actuator based on the cloth detection signal generated by said sensor of said belt moving/stopping unit and for controlling cloth position including stopping said belt by applying said brake roller upon receipt of the said cloth detection signal generated by said sensor when the cloth is placed on said mounting stand and said belt starts running.

2. An apparatus for spreading rectangular cloth according to claim 1, further comprising a concave front edge positioned following said convex front edge; a nozzle box having a top surface which is flush with said upper surface, said nozzle box being installed positioned adjacent a concave center line of said concave front edge, said nozzle box having a plurality of nozzle holes for blowing air at an angle to a movement direction of the cloth; an air source for sending air to said nozzle box; and a guide plate for guiding a tail-shaped corner of the cloth, which is blown up by air blown from said nozzle holes, to place the cloth at a predetermined position on said mounting stand.

3. An apparatus for spreading rectangular cloth according to claim 1, further comprising cloth aligning :means including a suction belt disposed at a lower part of said convex front edge, to form a cloth introducing portion, said suction belt running horizontally and forming a convex vertical side face following a convex form of said convex front; vertical axis pulleys having a plurality of suction holes, said suction belt being guided by said vertical axis pulleys; a suction duct which is housed within said suction belt, said suction duct having a face in contact with said convex vertical side face of said suction belt; a discharge pipe for discharging air from said suction duct; a suction blower; a motor for driving said suction belt; a cloth detection sensor disposed along a cloth side edge pull-in line on a horizontal surface of said cloth introducing portion; and a control circuit for detecting a deviation of a cloth side edge based on a signal generated by said cloth detection sensor and for issuing a command for normal or reverse rotation and for stopping said belt to correct a position through which said cloth side edge passes.

4. An apparatus for spreading rectangular cloth according to claim 3, further comprising: a concave front edge following said convex front edge of said cloth introducing portion of said mounting stand; a nozzle box installed on a frame adjacent to said concave center line of said concave front edge, said nozzle box having a top surface which is flush with said upper surface, said nozzle box having a plurality of nozzle holes for blowing air at an angle to a movement direction of the cloth; an air source for supplying air to said nozzle box; and a guide plate for guiding a tail-shaped corner of the cloth, which is blown up by air blown from said nozzle holes, to place said cloth at a predetermined position on said mounting stand.

5. An apparatus for spreading rectangular cloth according to claim 1, wherein said suction duct pulls on a portion of said cloth edged side of said cloth running surface of said mounting stand; and cloth aligning means including a suction belt conveyor disposed at a location which is covered by the cloth when the cloth is drawn, at a center of a cloth guide plate mounted between said convex front edge, at said cloth introducing portion, and said mounting stand, said suction belt being driven in both a cloth drawing direction and a direction perpendicular to said cloth drawing direction, said suction belt including a plurality of suction holes; a suction duct installed at a lower part of said suction belt conveyor and having an open upper part; a servo motor for driving said suction belt conveyor, said servo motor having a brake and being rotatable in a normal and reverse direction; a cloth detection sensor on said cloth side edge pull-in line on said cloth guide plate; and a control circuit for detecting a deviation of said cloth side edge based on said signal generated by said cloth detection sensor and for issuing a command for normal or reverse rotation and for stopping of said motor for correction of a position through which the cloth side edge passes.

* * * * *